US008152700B2

(12) United States Patent
Adams

(10) Patent No.: US 8,152,700 B2
(45) Date of Patent: Apr. 10, 2012

(54) MULTISTATION EXERCISE APPARATUS

(76) Inventor: Frederick R. Adams, Healdsburg, CA (US)

( * ) Notice: Subject to any disclaimer, the term of this patent is extended or adjusted under 35 U.S.C. 154(b) by 139 days.

(21) Appl. No.: 12/846,584

(22) Filed: Jul. 29, 2010

(65) Prior Publication Data

US 2011/0028280 A1 Feb. 3, 2011

Related U.S. Application Data

(60) Provisional application No. 61/229,670, filed on Jul. 29, 2009.

(51) Int. Cl.
*A63B 21/06* (2006.01)

(52) U.S. Cl. ..... 482/94; 482/97

(58) Field of Classification Search ..... 482/38, 482/93, 94, 95, 96, 97, 98, 99, 100, 101, 482/102, 138; D21/686; 434/252
See application file for complete search history.

(56) References Cited

U.S. PATENT DOCUMENTS 5,011,139 A * 4/1991 Towley, III ..... 482/38
5,242,344 A * 9/1993 Hundley ..... 482/93
5,322,489 A * 6/1994 Webb et al. ..... 482/38
5,372,556 A * 12/1994 Ropp ..... 482/41
5,487,712 A * 1/1996 Kann ..... 482/97
5,499,959 A * 3/1996 Holmes et al. ..... 482/95
6,641,509 B1 * 11/2003 Chen ..... 482/94
7,070,546 B1 * 7/2006 Grasso ..... 482/103
7,955,223 B1 * 6/2011 Gilman ..... 482/14
2007/0161472 A1 * 7/2007 Drechsler ..... 482/100
2007/0232464 A1 * 10/2007 Chu ..... 482/96
2009/0098986 A1 * 4/2009 Quinn ..... 482/100

* cited by examiner

*Primary Examiner* — Loan Thanh
*Assistant Examiner* — Tam Nguyen
(74) *Attorney, Agent, or Firm* — Craig M. Stainbrook; Stainbrook & Stainbrook, LLP

(57) ABSTRACT

A multistation weight machine including a cam pivotally connected to the base on an lever axle that functions as the sole and central pivot point for a class II lever in the machine's lever system. A plurality of handles storable on the apparatus are removably insertable into a plurality of variously positioned handle receptacles operatively connected to the lever axle and provide means for performing a wide variety of exercises in a standing position. One or more foot pedals or any handle connected to the lever axle through a handle receptacle results in the smooth upward linear translation of all or a portion of a weight stack.

16 Claims, 33 Drawing Sheets

MULTISTATION EXERCISE APPARATUS

CROSS REFERENCES TO RELATED APPLICATIONS

The present application claims the benefit of U.S. Provisional Patent Application Ser. No. 61/229,670 filed Jul. 29, 2009.

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

INCORPORATION-BY-REFERENCE OF MATERIAL SUBMITTED ON A COMPACT DISC

Not applicable.

SEQUENCE LISTING

Not applicable.

BACKGROUND OF THE INVENTION

1. Field of the Invention

The present invention relates generally to exercise machines, and more particularly to multistation weight machines, and still more particularly to a multistation captive stack weight system and apparatus that enables a user to achieve a full body workout, including a core workout, from a standing position exclusively, though numerous seated exercises are also possible.

2. Discussion of Related Art Including Information Disclosed Under 37 CFR §§1.97, 1.98

Multistation exercise and weight machines are well known. A number of major exercise machine manufacturers make and sell commercial and residential machines either dedicated to particular exercises or a small group of exercises designed to exercise small groups of muscles or, alternatively, machines designed to enable a user to perform a number of exercises and to address a wide range of muscles and muscle groups. Typically, the systems for stack machines include the use of one or more weight stacks, each comprising a plurality of weight plates penetrated by one or two generally vertical stabilizing rods and over which a cable and pulley system is arranged so that the stack may be lifted by pulling the cable in some direction from an upper or terminal pulley and using any of a variety of apparatus—a bar held in the hands, a plate pushed by the legs and feet, a padded bar moved radially with a body bend, and so forth. The number of plates lifted is typically determined by the placement of a pin under the lowest of the plates to be lifted and inserted through an indexing hole in a post disposed vertically through the middle of all of the plates and that is elevated along with the stack. In some machines the cable extending from the terminal pulley may extend directly to an implement held or moved by the user; in other machines, the cable may be disposed over a cam connected to the cable, the cam being connected to an element engaged and moved by the user, such that resistance can be distributed more evenly throughout a range of motion. Countless variations in station configuration, arrangement, and principles of operation have been tried, but most multistation systems are either lever or cable machines, while some are a combination.

Despite the maturity and the diversity that devices in the relevant technical art have now reached, no known multistation weight machine provides a user with the ability to achieve a full body workout while conducting all exercises in various standing positions. Furthermore, no system works using a plurality of handle receptacles or ports operatively connected to a single second class lever which is, in turn, connected to a single stack of weight plates and which are moved by a plurality of handles adapted for use in executing particular exercises and which are removably insertable in the handle ports.

BRIEF SUMMARY OF THE INVENTION

It is therefore a principal and primary object of the present invention to provide a new and improved multistation weight machine that enables a user to perform a complete workout from a standing position.

It is another object of the present invention to provide a new and improved weight machine in which most exercises are performed with the feet placed on the ground, thereby minimizing the risk of injury and requiring that core stabilizing and balancing muscles be recruited to perform exercises properly and smoothly.

A further object or feature of the present invention is to provide a multistation exercise machine that provides means to connect variously configured handles to a single second class lever, which is in turn connected to a single stack of weight plates.

Still another object of the present invention is to provide a stack system with multiple stations that enable a user to get a resistance training core workout from a standing position.

An even further object of the present invention is to provide a stack-based weight training apparatus for resistance training that enables users to easily and rapidly configure exercise stations for complex sport-specific exercises.

Other novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty that characterize the invention are pointed out with particularity in the claims annexed to and forming part of this disclosure. The invention does not reside in any one of these features taken alone, but rather in the particular combination of all of its structures for the functions specified.

The foregoing summary broadly sets out the more important features of the present invention so that the detailed description that follows may be better understood, and so that the present contributions to the art may be better appreciated. There are additional features of the invention that will be described in the detailed description of the preferred embodiments of the invention which form the subject matter of the claims filed herein.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
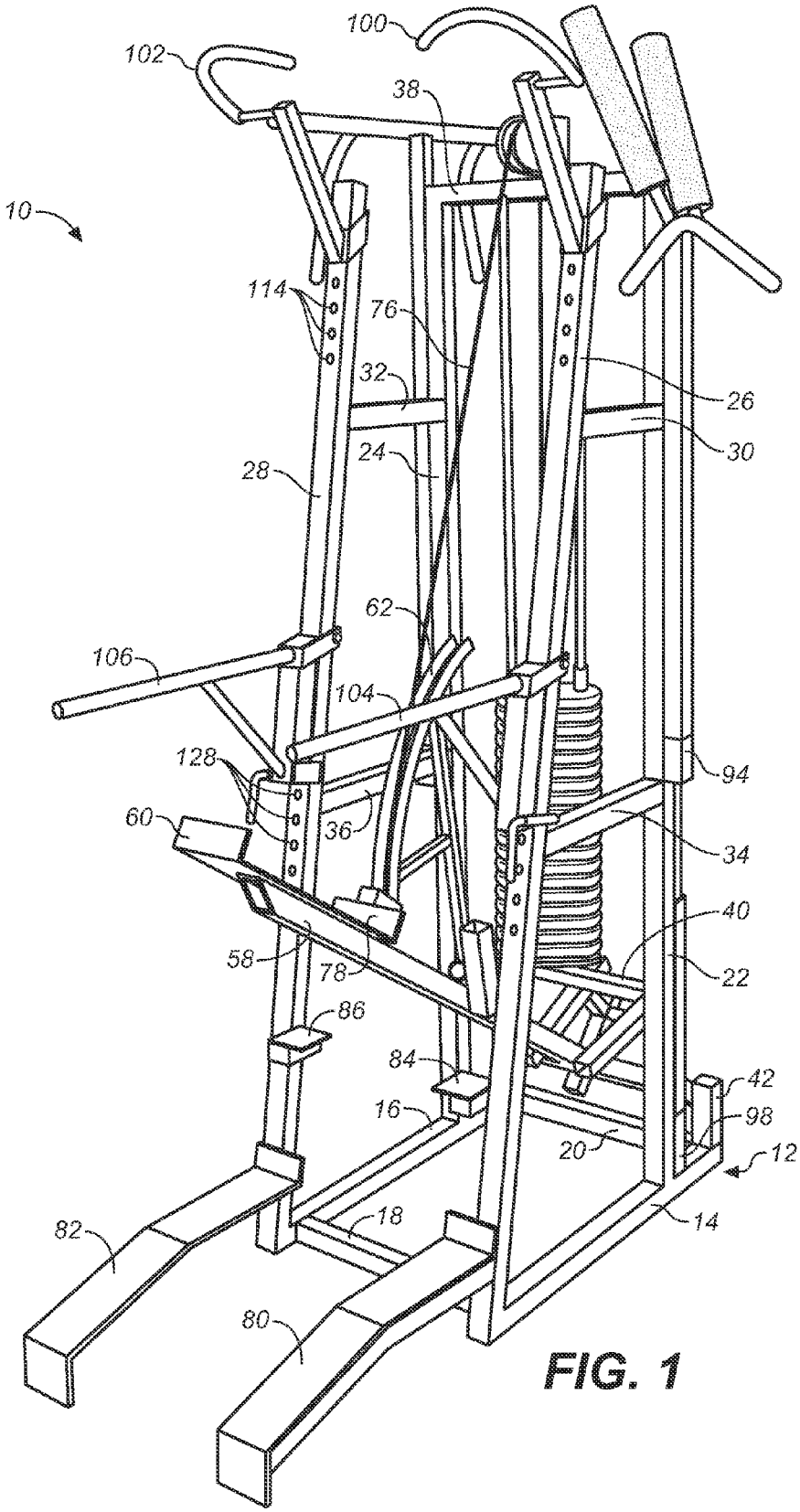
FIG. 1 is an upper front right perspective view of the inventive multistation exercise apparatus.

Referring to FIGS. 1 through 16B, wherein like reference numerals refer to like components in the various views, there is illustrated therein a new and improved multistation exercise apparatus, generally denominated 10 herein.

FIG. 1 illustrates a first preferred embodiment of the inventive exercise apparatus, showing that in its most essential form the device includes a stable planar base 12, preferably comprising welded elements of structural carbon steel square tubing in either a square or rectangular configuration. Other base geometries are clearly possible and may be desirable when the system includes exercise stations additional or auxiliary to those shown in the illustrations herein. In the rectangular configuration, the base includes right and left base bars, 14, 16, and front and back base bars, 18, 20.

Extending substantially vertically from points proximate the back ends of right and left base bars are right and left rear vertical supports, 22, 24. Extending either substantially vertically, or more preferably angling slightly rearwardly, are right and left front vertical supports, 26, 28. Joining the right and left front and rear vertical supports are right upper and left upper horizontal side bars, 30, 32, and right lower and left lower horizontal side bars 34, 36. Joining right and left rear vertical supports are upper rear transverse bar 38 and lower transverse bar 40. As will be appreciated by reference to the drawings, the side and transverse bars are preferably disposed in a generally horizontal position, though angled orientations are possible. The combination of vertical and horizontally disposed bars creates an upright frame on which are disposed further structural and functional elements that constitute exercise stations. Further, the upright frame includes the weight rack that functions as the resistance for many lifts, and includes storage racks for handles.

Extending upwardly from the back ends of the right and left base bars are right and left axle supports, 42, 44, each of which includes a shaft or pin 46, 48. A lever axle 50 is pivotally disposed on each of the pins and operatively connects them such that they function together as the fulcrum for the single operational lever on which all resistance exercises are performed.

A plurality of handle receptacles 52, 54, 56 are securely affixed to the lever axle proximate the central region of the lever axle and extend slightly rearwardly so as to provide an opening for inserting handles for configuring the system to perform myriad exercises. Operatively connected to, and extending forward from the lever axle, is a lever arm in the form of a foot pedal 58 having a step plate 60 disposed on its end. An arcuate cam 62 is disposed medially on the foot pedal and includes frame elements 64 for structural support.

A pulley 66 and pulley support plate 68 are disposed on upper rear transverse bar 38, and a weight stack 70 is supported on a weight stack base plate 72 affixed to the lower rear transverse bar 40. The plates comprising the weight stack slide up and down on spaced apart, side-by-side rails 74 extending from the pulley support plate, through the weight stack, and to the weight stack base plate.

A 76 cable extends from a front termination point 78 on the foot pedal over pulley 66 and down to the upper end of a weight selector rod (not shown) having a plurality of holes that align with holes created by grooves in adjoining weight plates, such that by inserting a pin between plates and through a hole in the weight selector rod, the number of plates to be lifted in an exercise is determined (which apparatus and method is well known in the art). As will be appreciated by those with skill in the art, by having the weight cable disposed over a cam connected to the foot pedal, which is the central lever arm in the lever system, the radial translation of the foot pedal or of any handle connected to the lever axle through a handle receptacle results in the smooth linear translation of a portion of the weight stack upwardly.

Extending forward from the front of the base are right and left steps 80, 82, which enable a user to step on to and mount the apparatus to use the foot pedal for leg exercises, or to ascend to the chin or dip stations (described below). Upper right and left steps 84, 86 further facilitate an ascent to the stations that require some elevation.

Base exercises are conducted using the above-described foot pedal and handle receptacles as the operative connections to the lever axle. However, one or more auxiliary sets 88 of handle receptacles 90, 92, can also be provided for exercises that involve handle movement to the side of the base (see FIGS. 10-12B and FIGS. 15A-B).

Efficiency in use is substantially enhanced by the provision of a plurality of handle ports 94, 96, 98, in which various handles may be stored when not in use.

Completing the system elements that generally comprise the base system and which are installed on a substantially permanent basis, albeit adjustably installed, are a chin up station having adjustable chin up handles 100, 102, and a dip station having adjustable dip station bars 104, 106, each station structurally disposed on the right and left front vertical supports.

The chin up handles each include a grip 108 attached to an angled support 110 which extends from a sleeve 112 that is slidably installed over its respective vertical support. The sleeve includes an interior pin (not shown) that inserts into a hole 114 in the vertical support to secure the handle at a selected height as long as the handle is either under the influence of gravity or bears a load from a user. When the handle is pushed up, the pin releases from the hole and the handle may be slid up or down to be secured at another height.

The dip station bars are similarly adjustably installed on the right and left vertical supports. However, the adjustment mechanism differs slightly. In this instance, each bar includes a handle portion 116, a collar 118, a down tube 120, an angled brace 122, and a latch pin 124 rotatably installed in a pin barrel 126. The down tube includes a locking pin (not shown) disposed on the side facing the vertical support. When the latch pin is rotated outward from the vertical support, the handle portion can be tipped upward to release the pin, and the entire bar assembly can slide up or down according to the user's preferences. The locking pin can then be secured in another through hole 128 in the vertical support.

In addition to the chin up station and the dip station, other exercises and groups of exercises can be performed by configuring various body-engaging elements provided for use with the mechanical elements of the apparatus. These include a Y-shaped squat bar 130, a rowing bar 132, a multipurpose handle or bar 134, and a neck exercise attachment bar 136. The squat bar, rowing bar, and multipurpose bar each include a lower end configured to insert tightly in the handle receptacle boxes so that moving the element rotates the lever axle and raises or lowers a selected portion of the weight stack.

In addition to the larger bars, there may be provided an adjustable sliding clamp or locking collar 138 and handles 140, connected to the sliding clamp via cable, that may be used in connection with the multipurpose bar for setting up complex core exercises, such as those shown in FIGS. 10A-12B and 15A-16B.

Referring next to FIGS. 4A through 12B, there is shown in various schematic side views a number of exercises performed with the inventive apparatus configured using the above-described multistation elements.

Figure 4A:
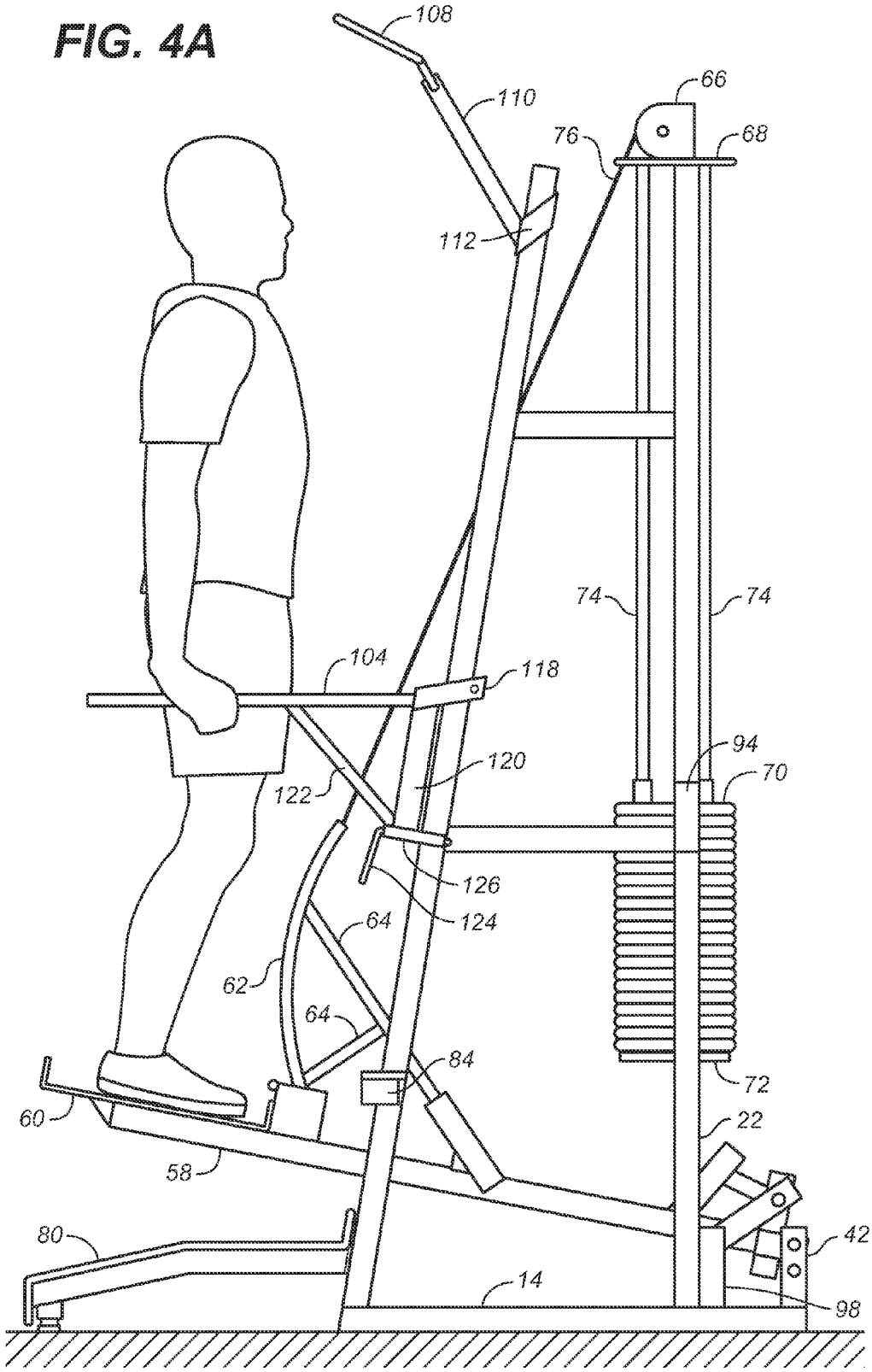
FIG. 4A is a schematic side view in elevation showing the assembled apparatus and a user poised to execute an assisted dip at the leg press/dip station.
Figure 4B:
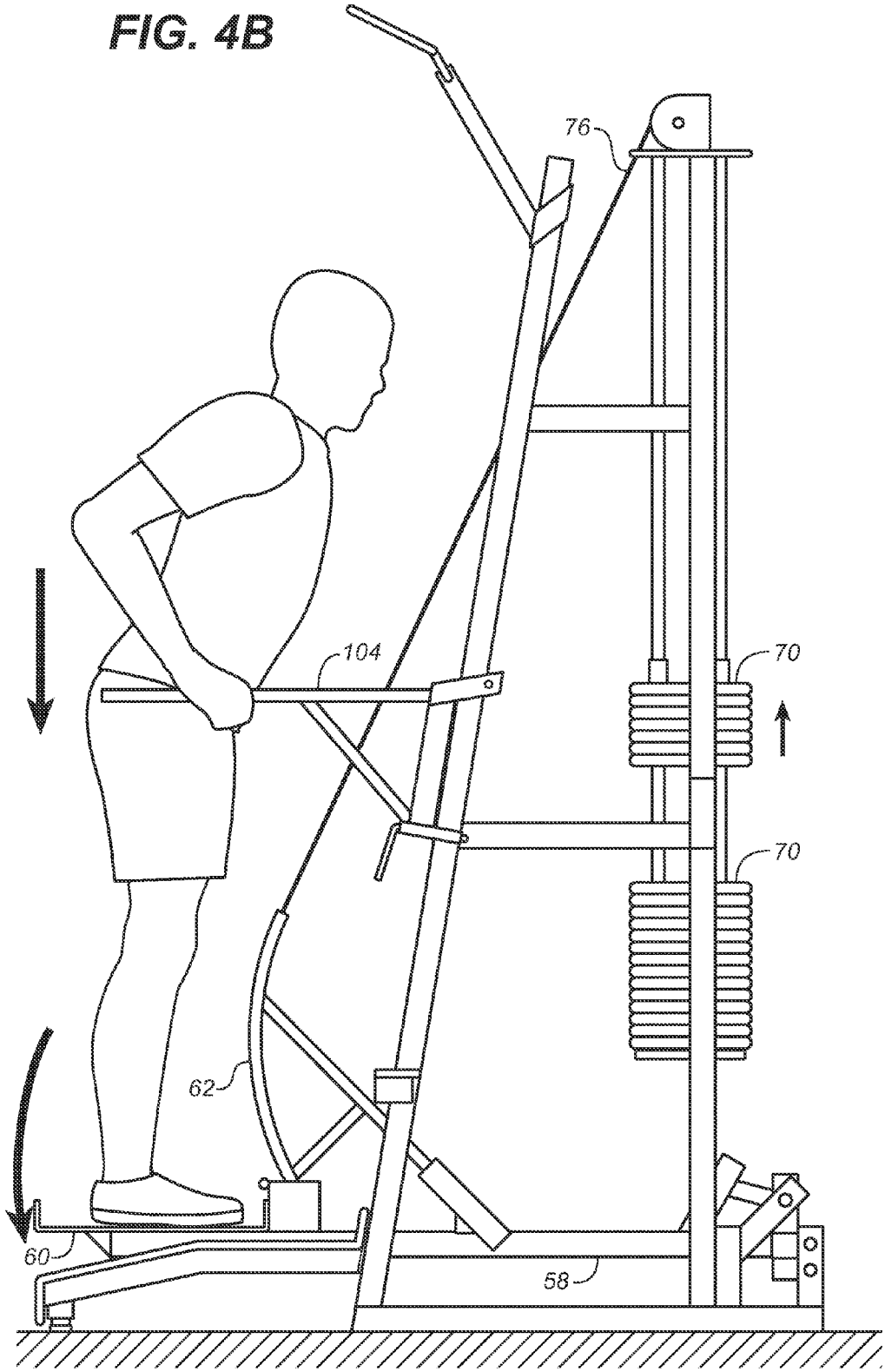
FIG. 4B shows the same user having been lowered between the dip bar handles at the leg press/dip station.

Beginning first with FIG. 4A, there is shown a user prepared to lower himself into position to execute an assisted dip at the standing leg press and dip station. The user holds the dip station handles and lowers himself between the handles, allowing the weight selected on the weight stack to resist his fall (clearly, the selected weight must be less than the user's weight; otherwise, it would require muscular assistance by the arms to pull the user down). FIG. 4B shows how the radial motion of the foot pedal translates into a slightly arcuate drop for the user. At FIG. 4B the user is poised to execute a forward leaning dip with the assistance of the raised portion of the weight stack, which will drop as the user raises himself using principally his triceps, lower pectoralis major, and anterior deltoids for arm extension.

Figure 4C:
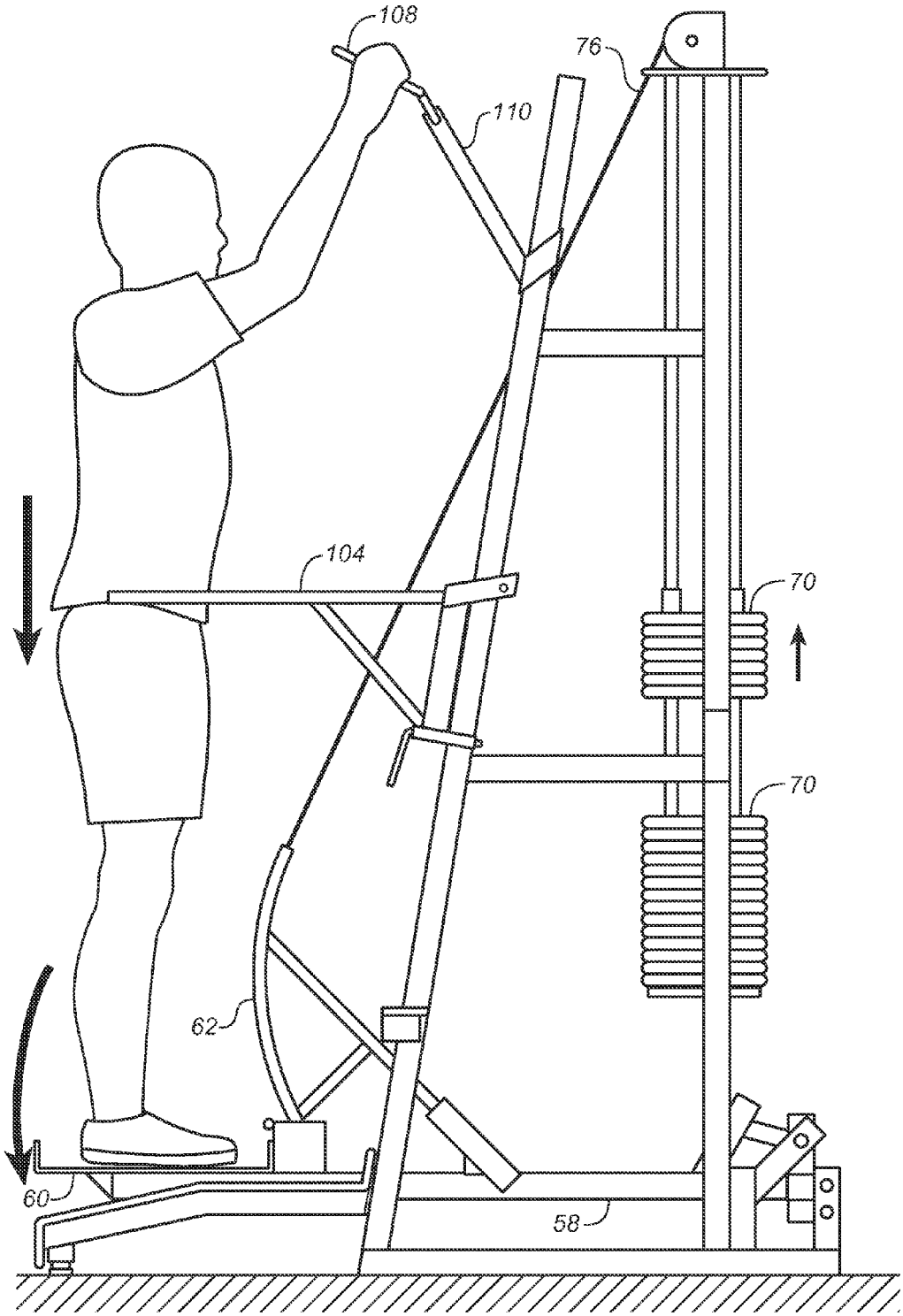
FIG. 4C shows a user at the starting position of the assisted chin up station.
Figure 4D:
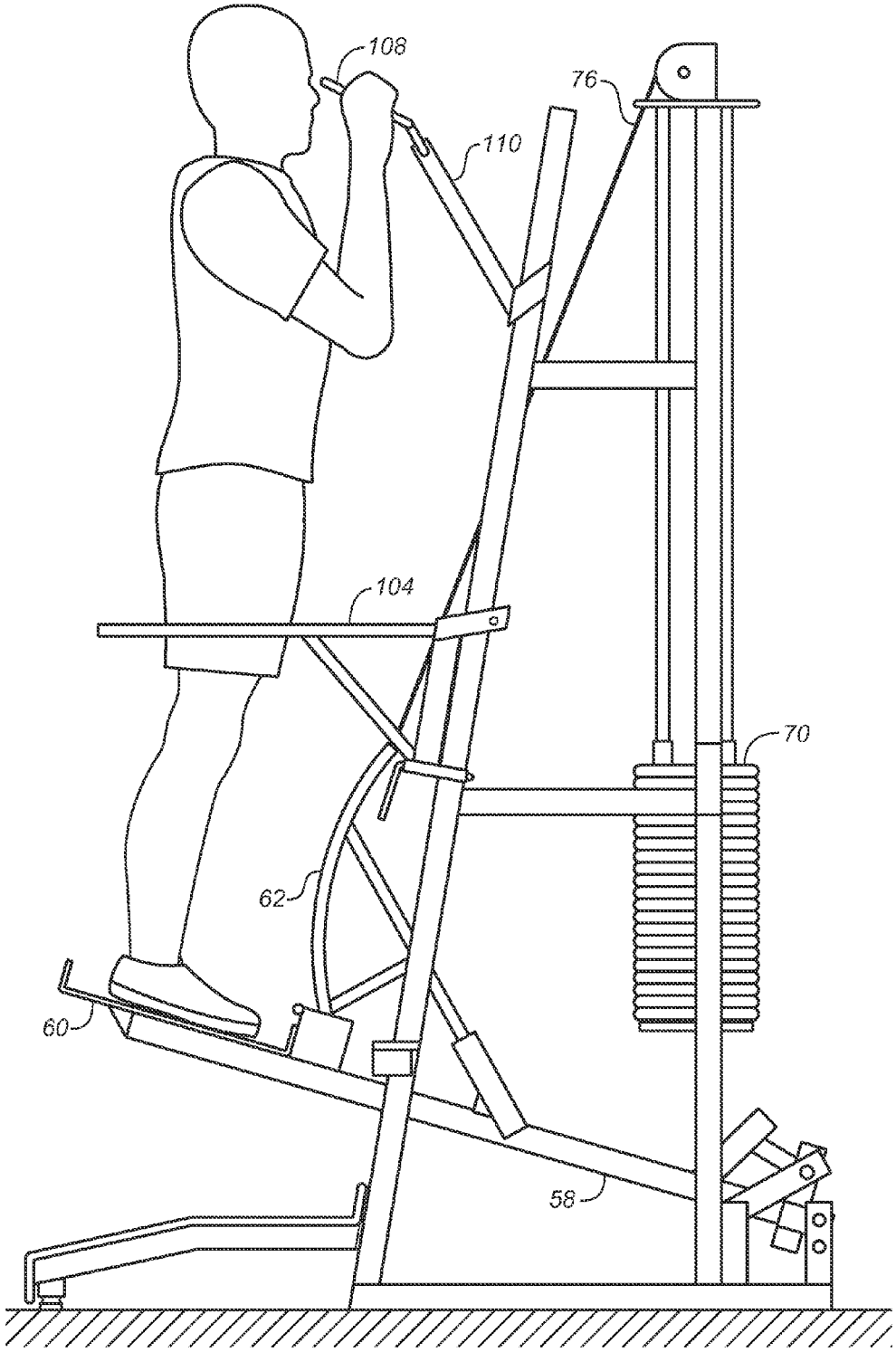
FIG. 4D shows the same user of FIG. 4C having executed an assisted chin up.

FIG. 4C shows a user at the starting position of the assisted chin up station, while FIG. 4D shows the same user of FIG. 4C having executed an assisted chin up. The principle of operation is essentially identical to that of the assisted dip.

Figure 5A:
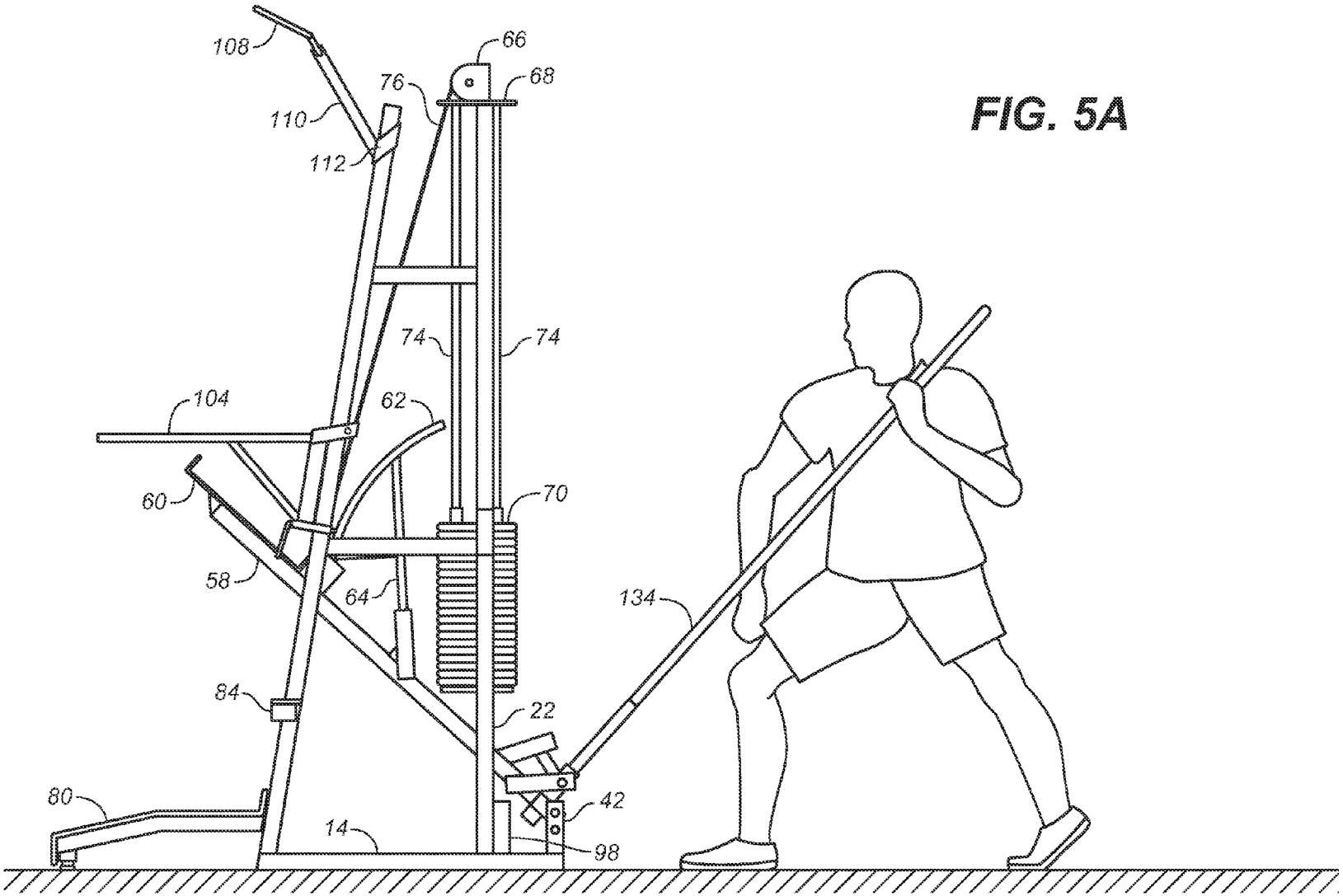
FIG. 5A is a schematic side view in elevation showing a user poised to execute a complex chest press with a lunge at a multi-exercise station configured for this exercise.
Figure 5B:
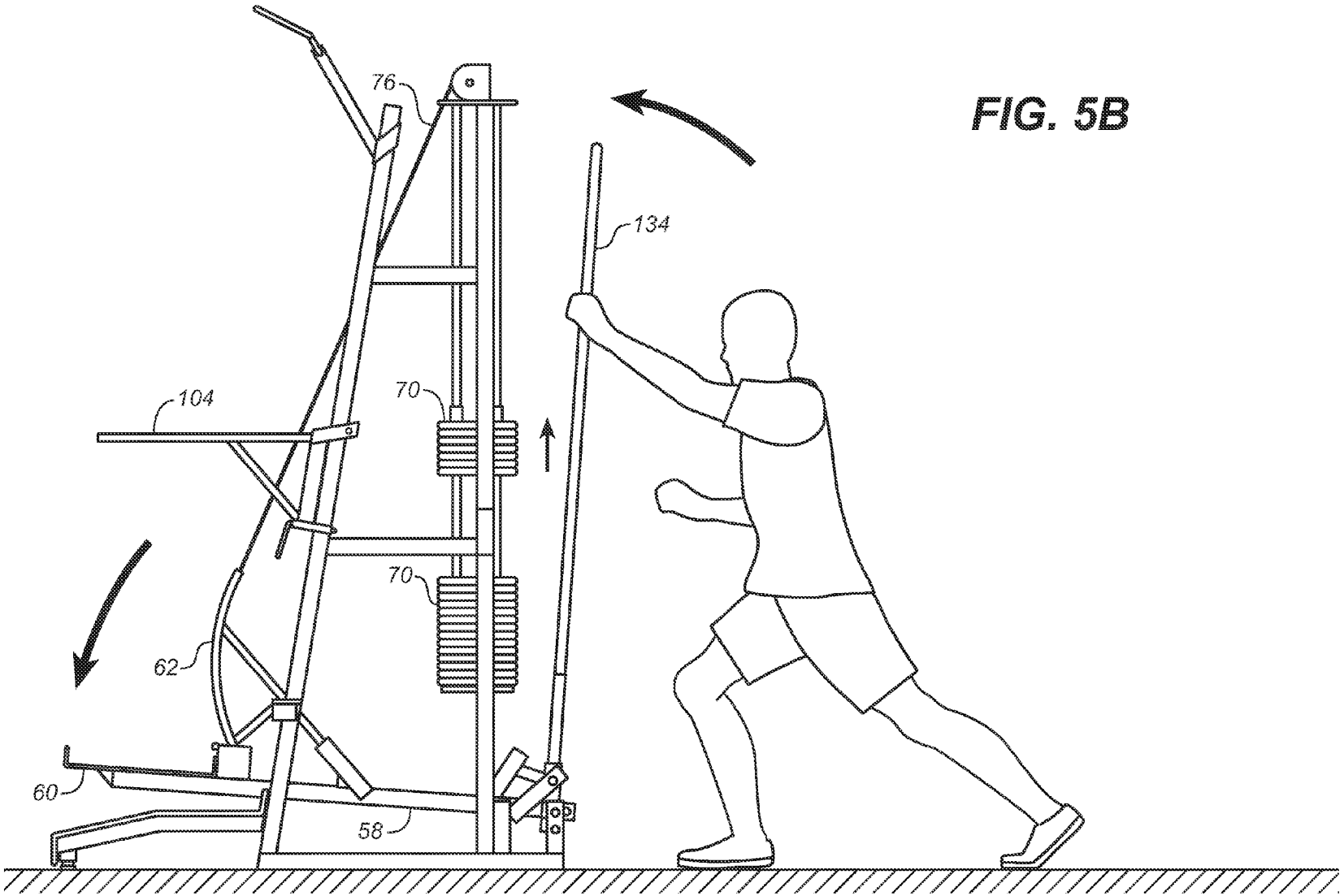
FIG. 5B shows the same user of FIG. 5A having executed the exercise.

FIGS. 5A and 5B show the multipurpose bar inserted into one of the handle receptacles so as to enable a user to push the bar with a single arm chest press including pelvic rotation and a forward lunge. This is but one of countless complex core exercises that recruit multiple muscle groups to move the load.

Figure 6A:
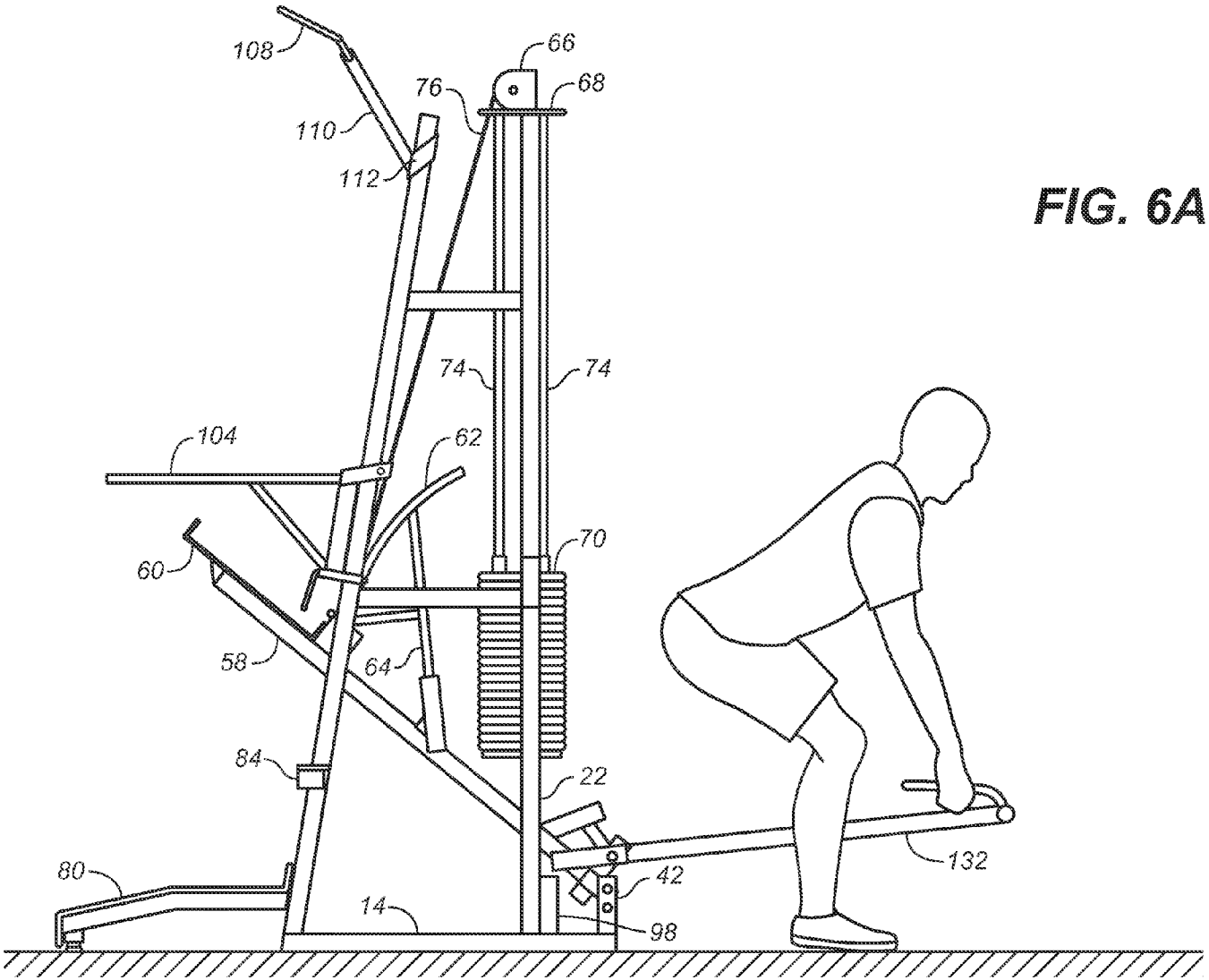
FIG. 6A shows a user poised to execute a row at a row/dead-lift station.
Figure 6B:
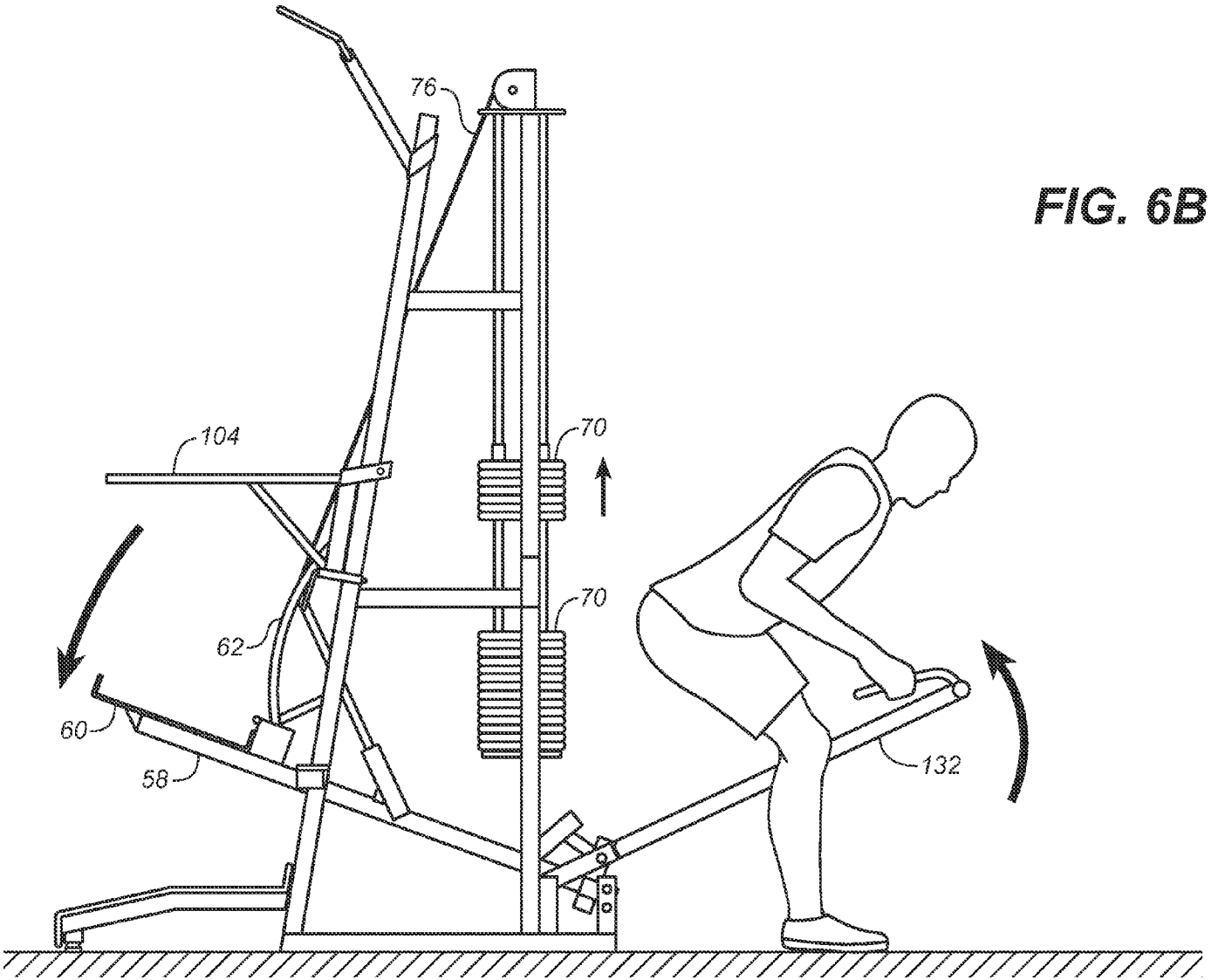
FIG. 6B shows the user of FIG. 6A having executed the rowing motion.

FIGS. 6A and 6B show the rowing bar inserted into a handle receptacle disposed at a low angle so as to enable a user to execute a chest row at a row/dead-lift station.

Figure 7A:
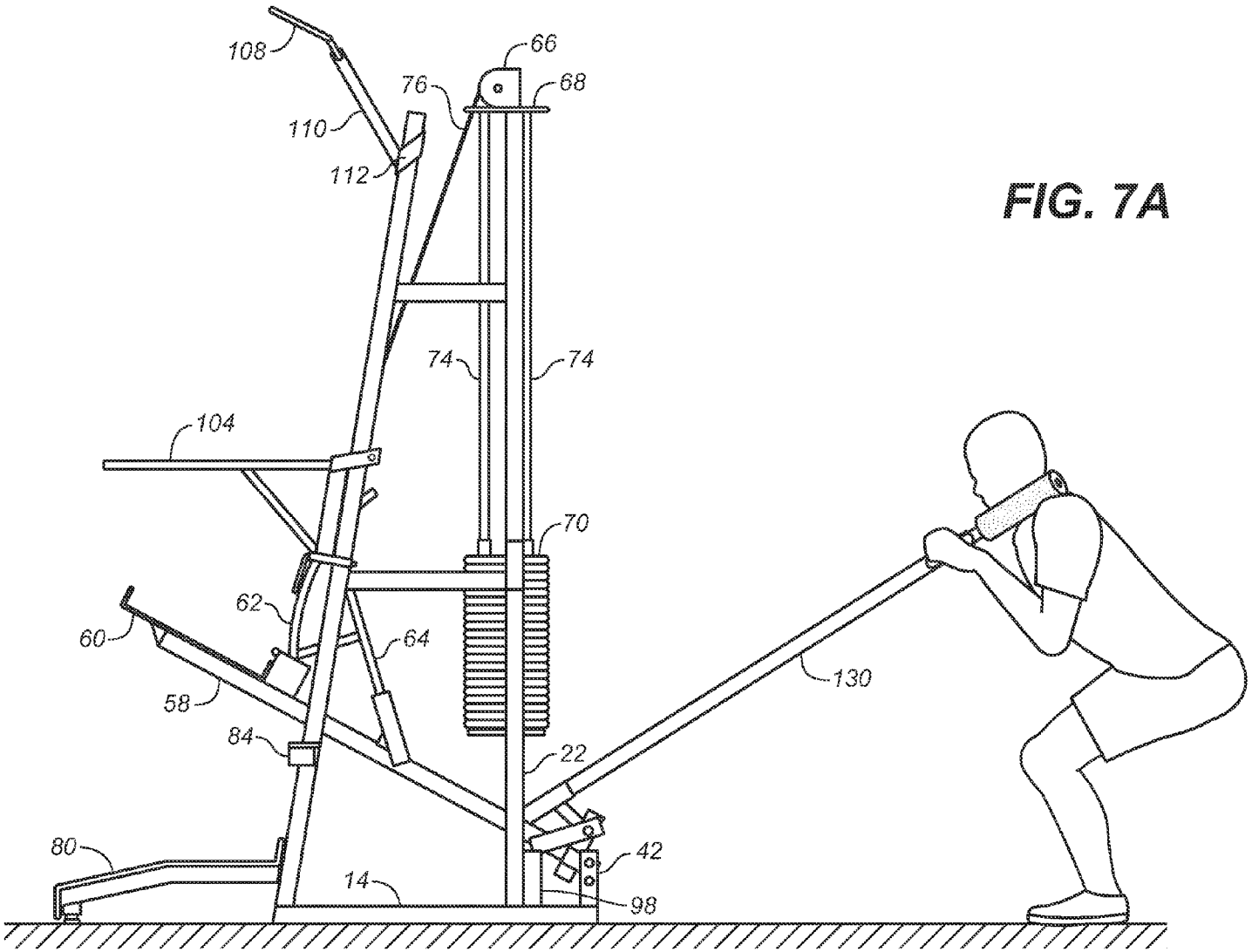
FIG. 7A shows a user prepared to execute a squat at a squat/calf-raise station.
Figure 7B:
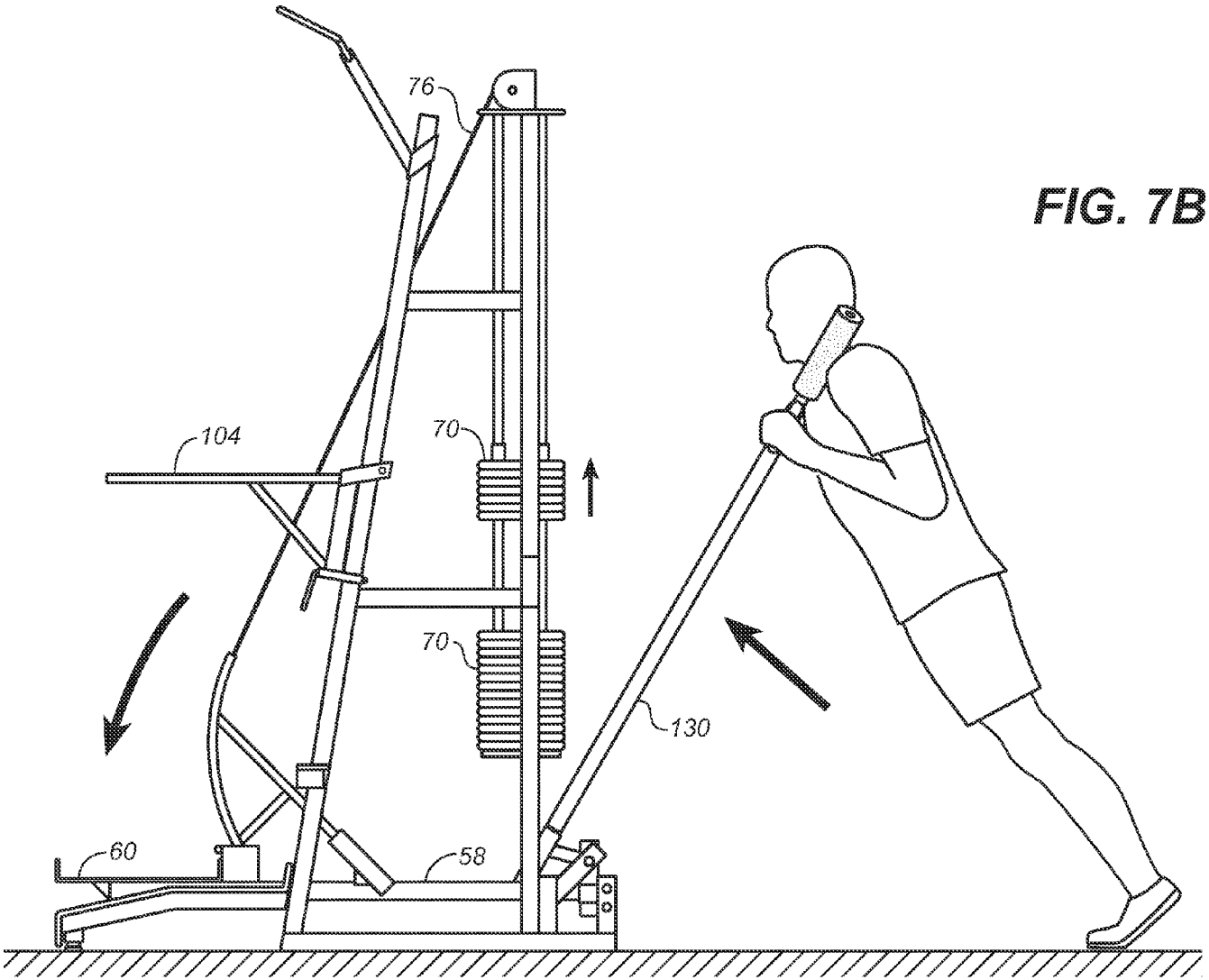
FIG. 7B shows the user of FIG. 7A having executed a squat with a calf raise at the terminal phase.

FIGS. 7A and 7B show a user executing a squat and calf raise at a squat/calf-raise station. This station is configured by inserting the squat bar into one of the medially disposed handle receptacles.

Figure 8A:
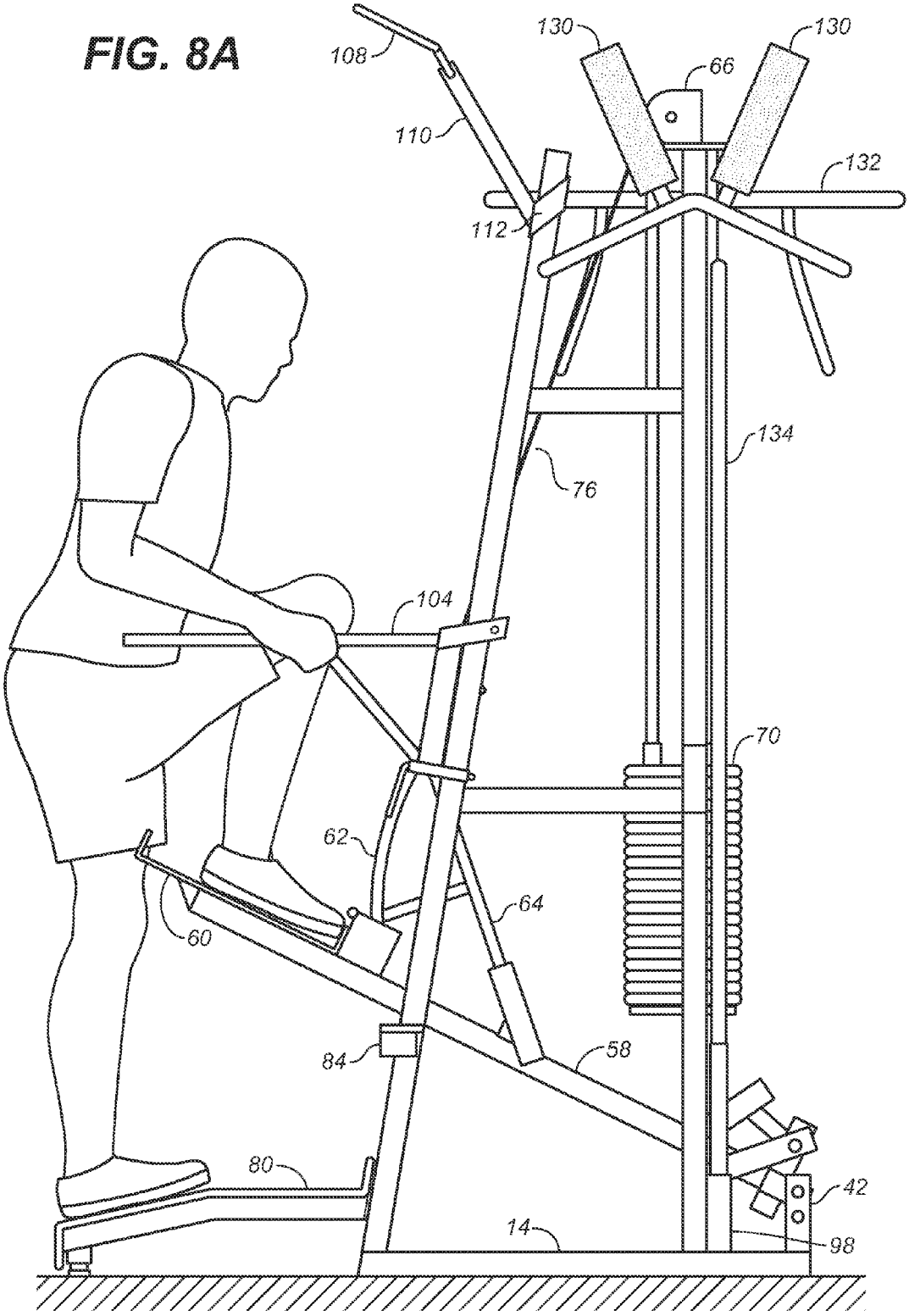
FIG. 8A shows a user poised to execute a single leg press at a step/leg press station.
Figure 8B:
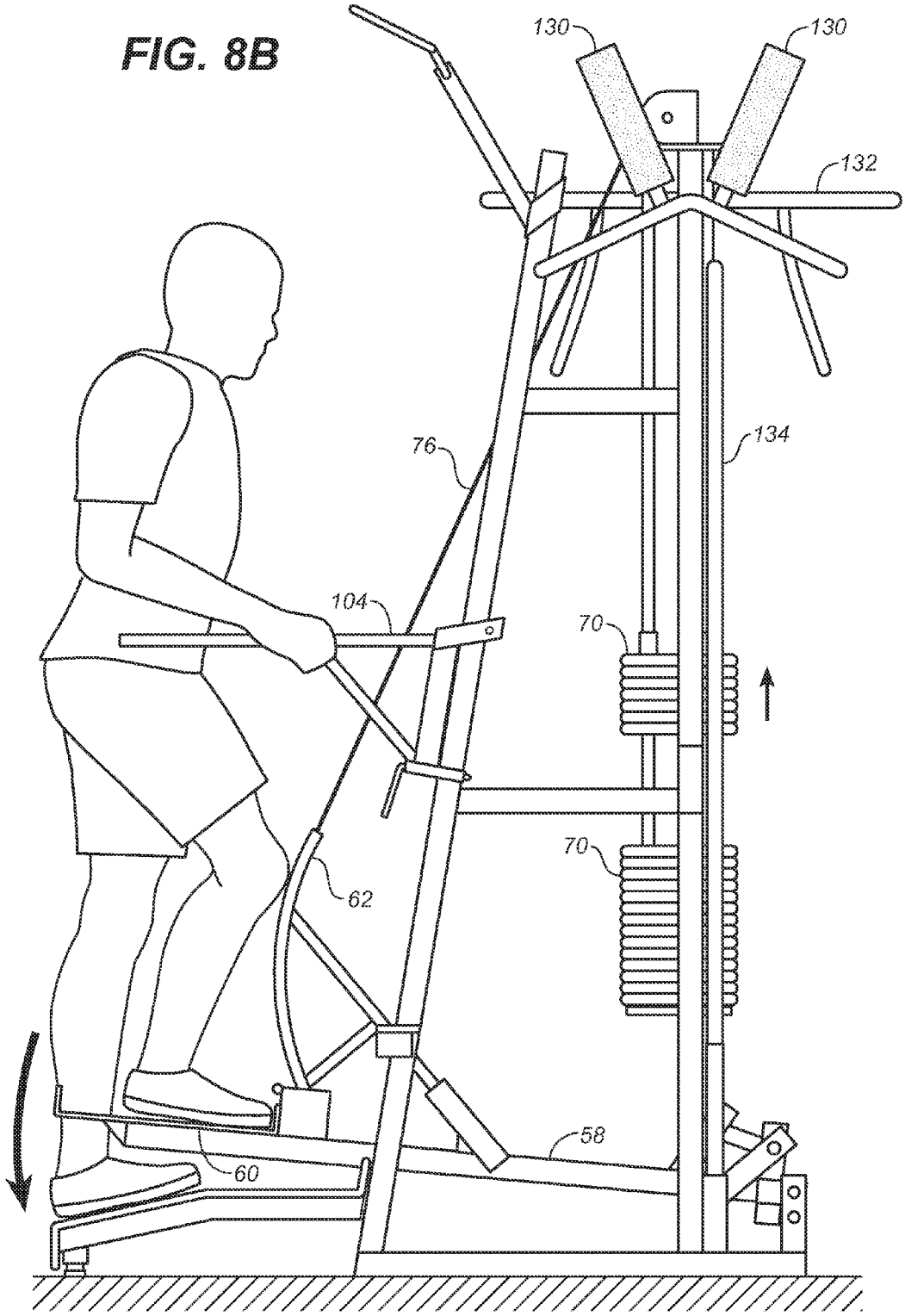
FIG. 8B shows the user of FIG. 8A having partially executed a single leg press.
Figure 9A:
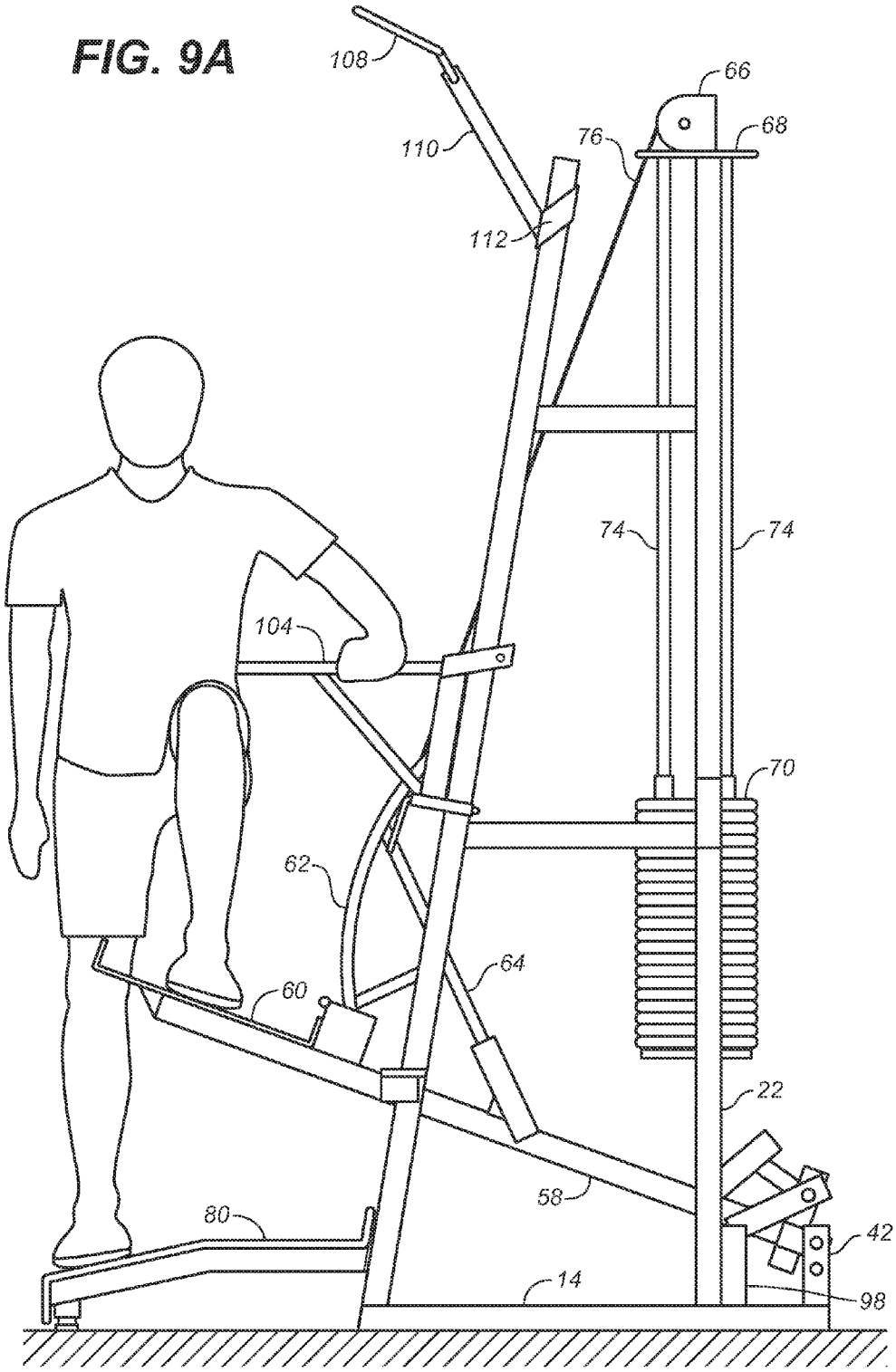
FIG. 9A shows a user prepared to execute an adduction exercise using the step/leg press station.
Figure 9B:
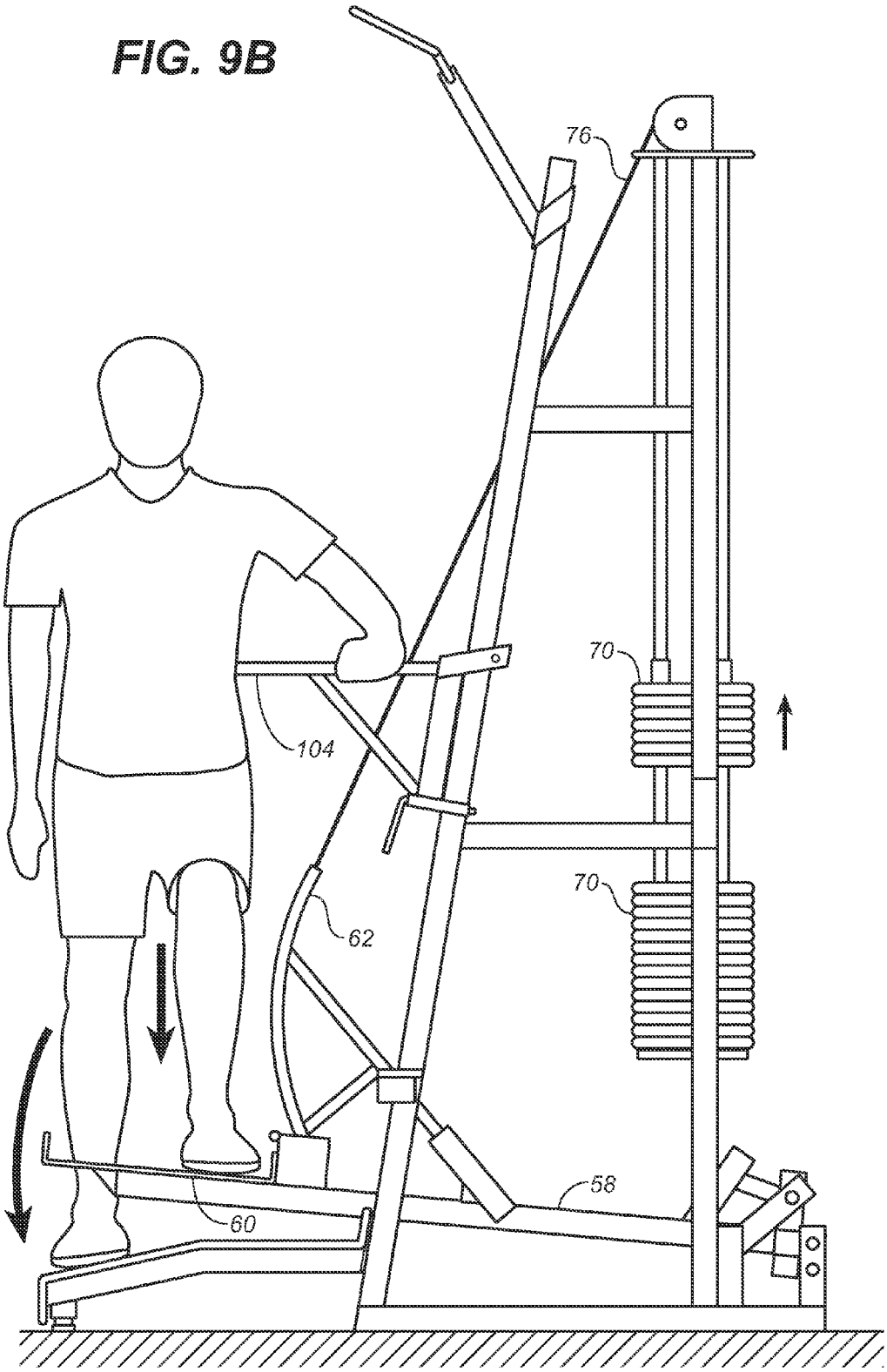
FIG. 9B shows the user of FIG. 9A having partially executed the exercise.

FIGS. 8A and 8B show a user executing a single leg press at the standing leg press station, while FIGS. 9A and 9B shows a user executing an adduction exercise at the same station.

Figure 10:
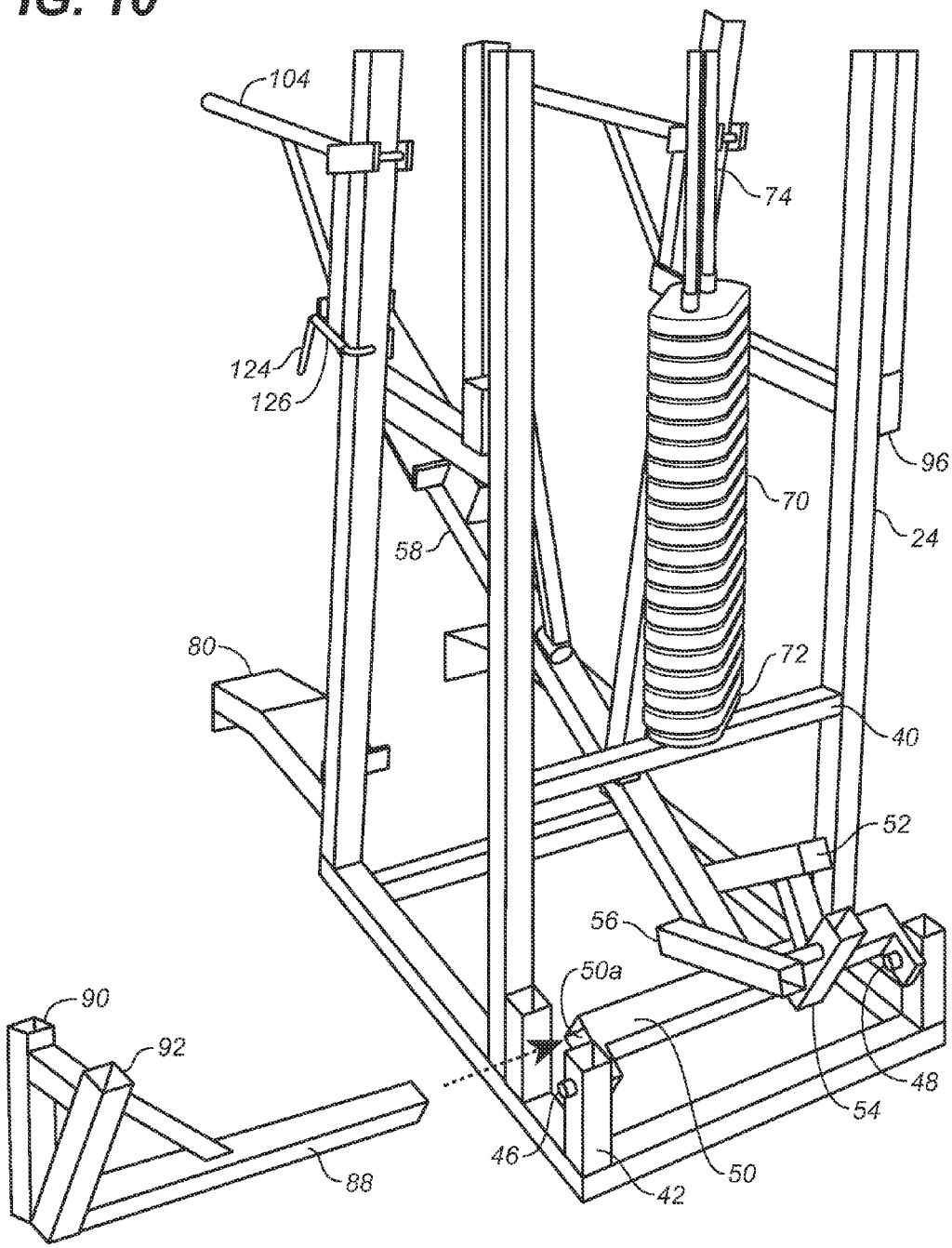
FIG. 10 is a partial exploded upper right rear perspective view showing the inventive apparatus with an auxiliary extension positioned for insertion into the fulcrum bar.

FIG. 10 is a partial exploded upper right rear perspective view showing how the auxiliary extension is inserted into the open end 50*a* of the lever axle 50.

Figure 10A:
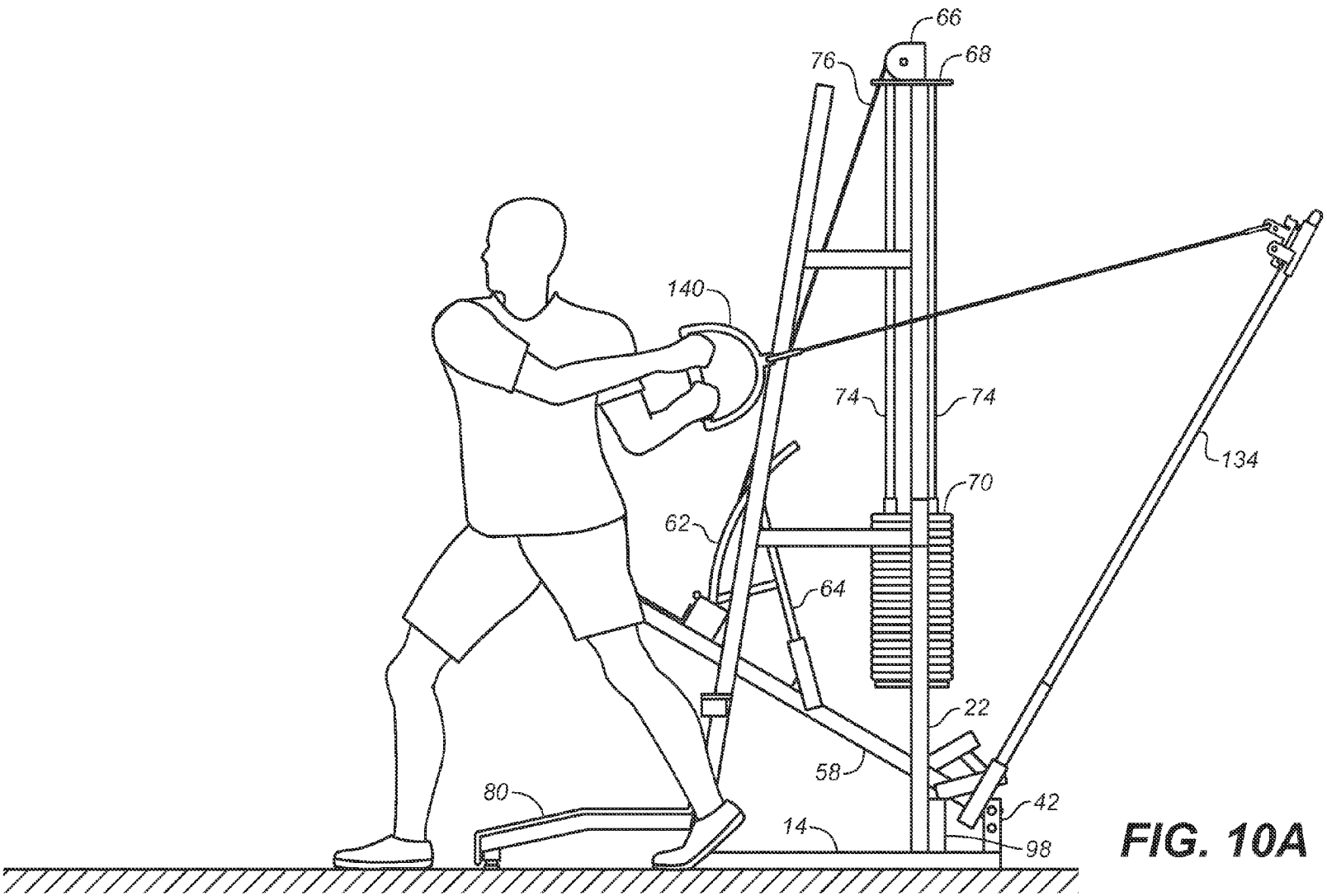
FIG. 10A is a schematic side view in elevation showing a user prepared to execute a hip rotation exercise using the striking/throwing station, this being a first of many exercises made possible by the addition of the auxiliary extension.
Figure 10B:
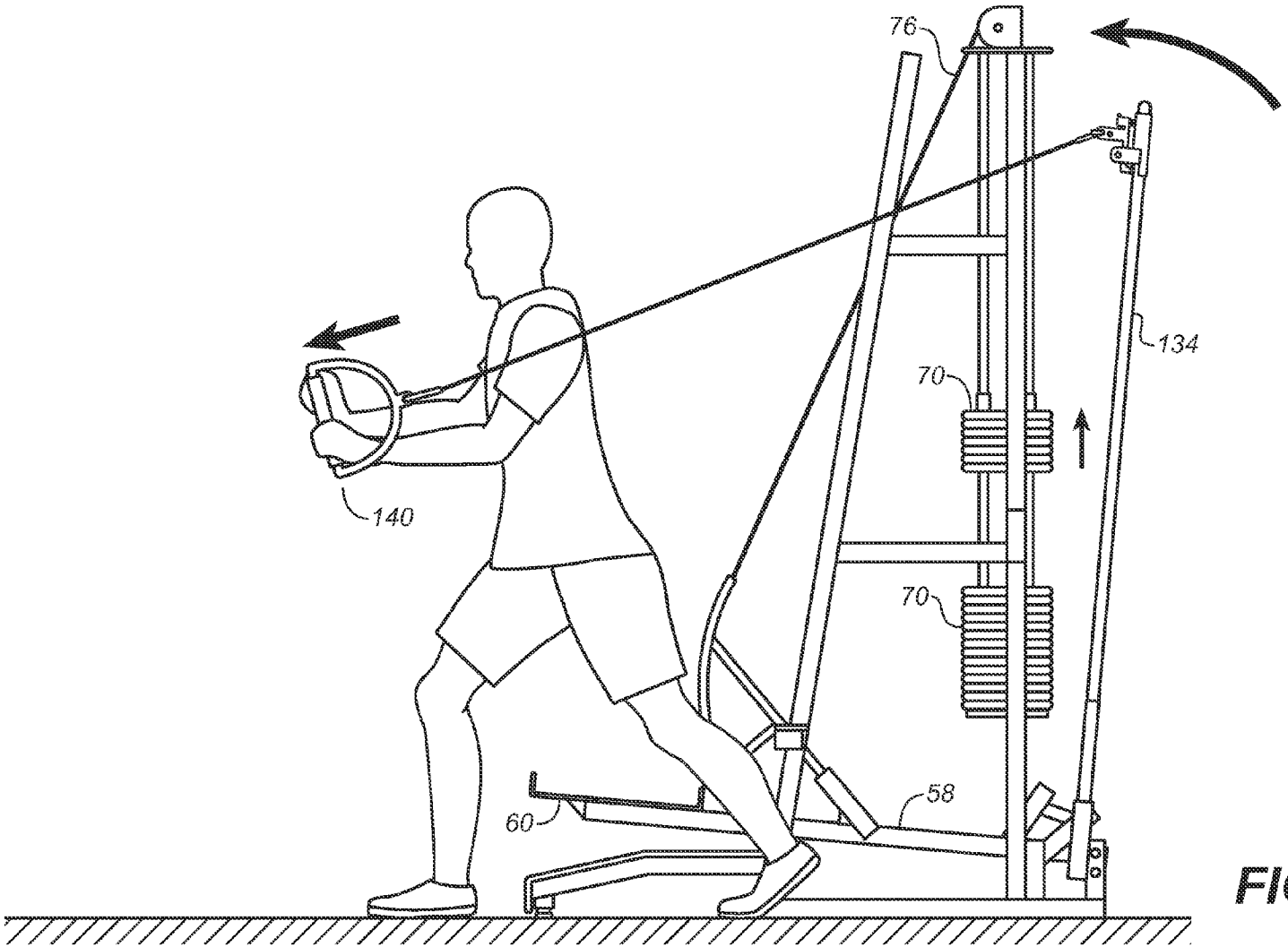
FIG. 10B shows the user of FIG. 10A having executed a twisting exercise.

FIGS. 10A and 10B show a user executing a hip rotation exercise. This is made possible by configuring a striking/throwing station by inserting the multipurpose bar into one of the handle receptacles disposed on the end of the auxiliary extension 88. This motion simulates a batting motion made by a baseball player.

Figure 11A:
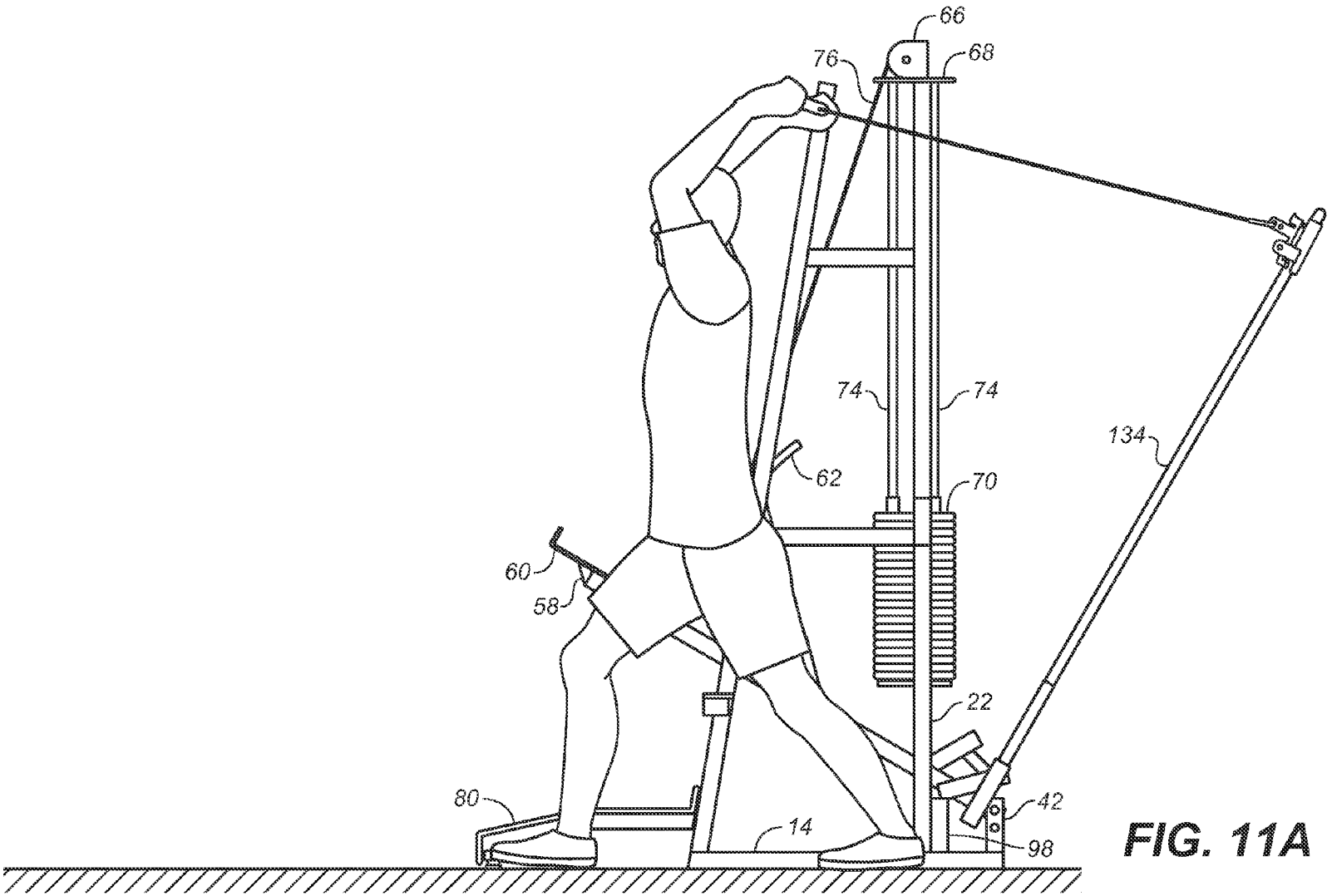
FIG. 11A is a schematic side view in elevation showing a user poised to commence an overhead pullover.
Figure 11B:
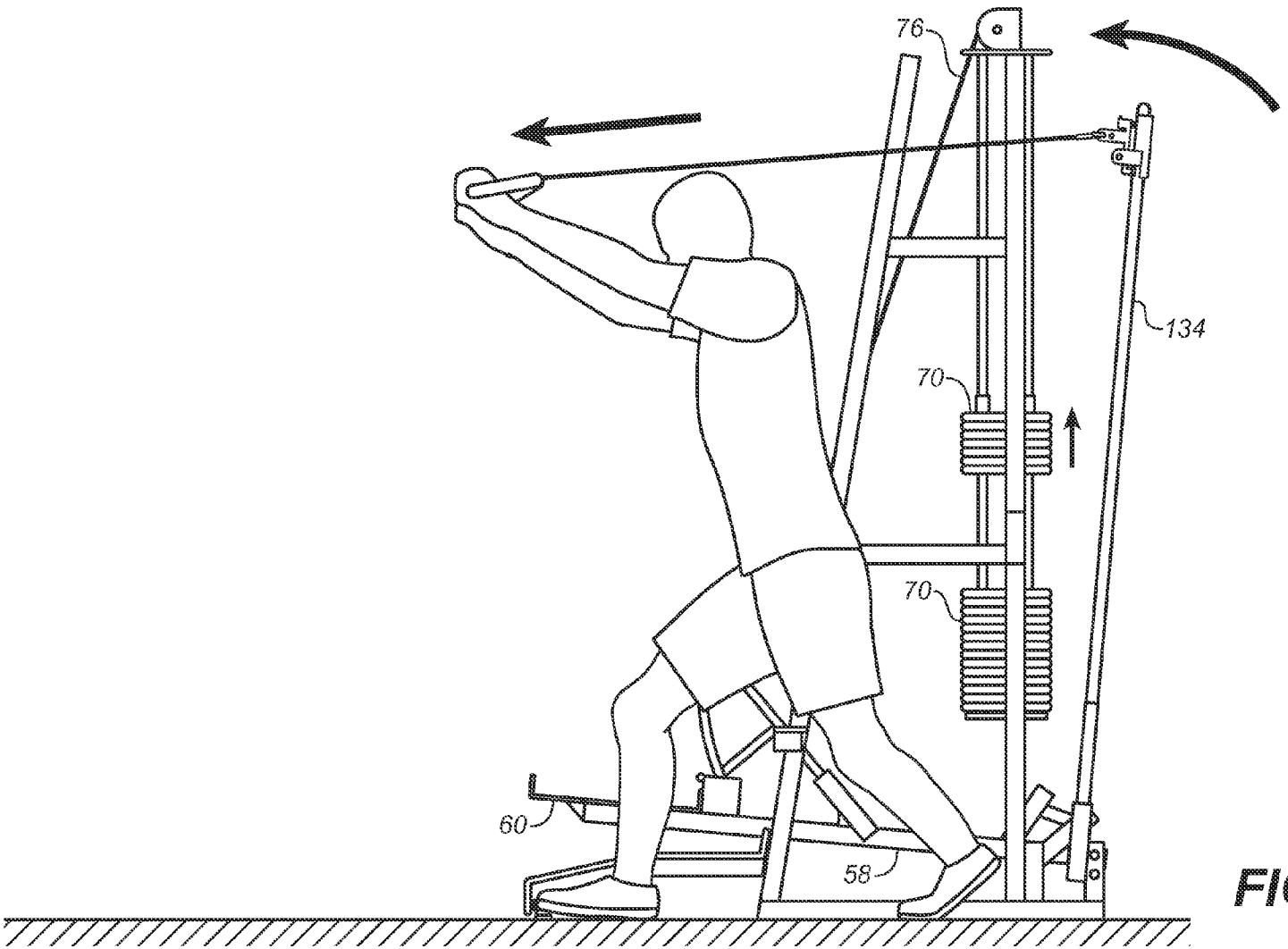
FIG. 11B shows the user of FIG. 11A having executed the pullover.

FIGS. 11A and 11B show a user executing an overhead pullover using the same striking/throwing station configuration shown in FIGS. 10A-10B.

Figure 12A:
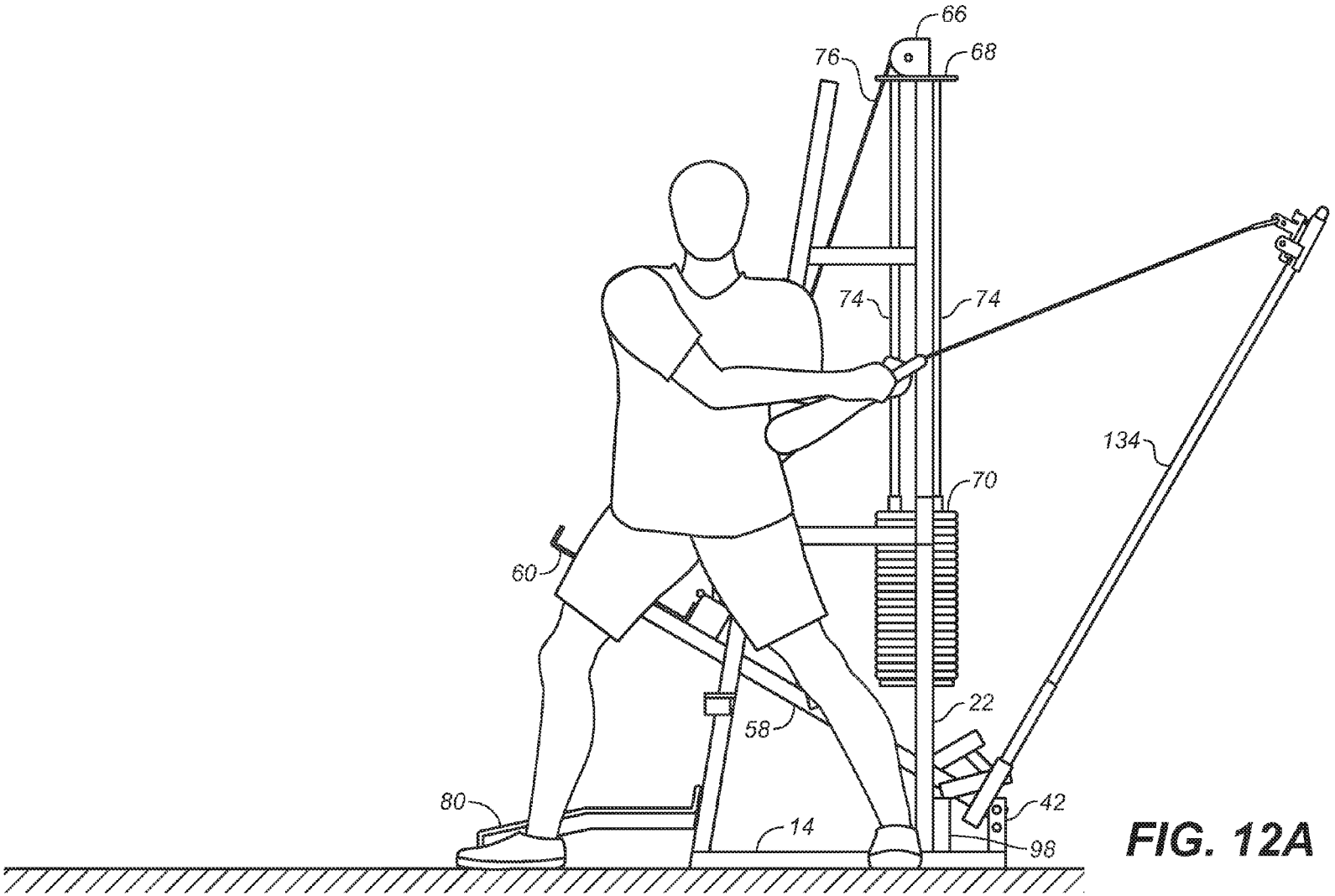
FIG. 12A is a schematic side view in elevation showing a user prepared to execute an exercise at the striking/throwing station.
Figure 12B:
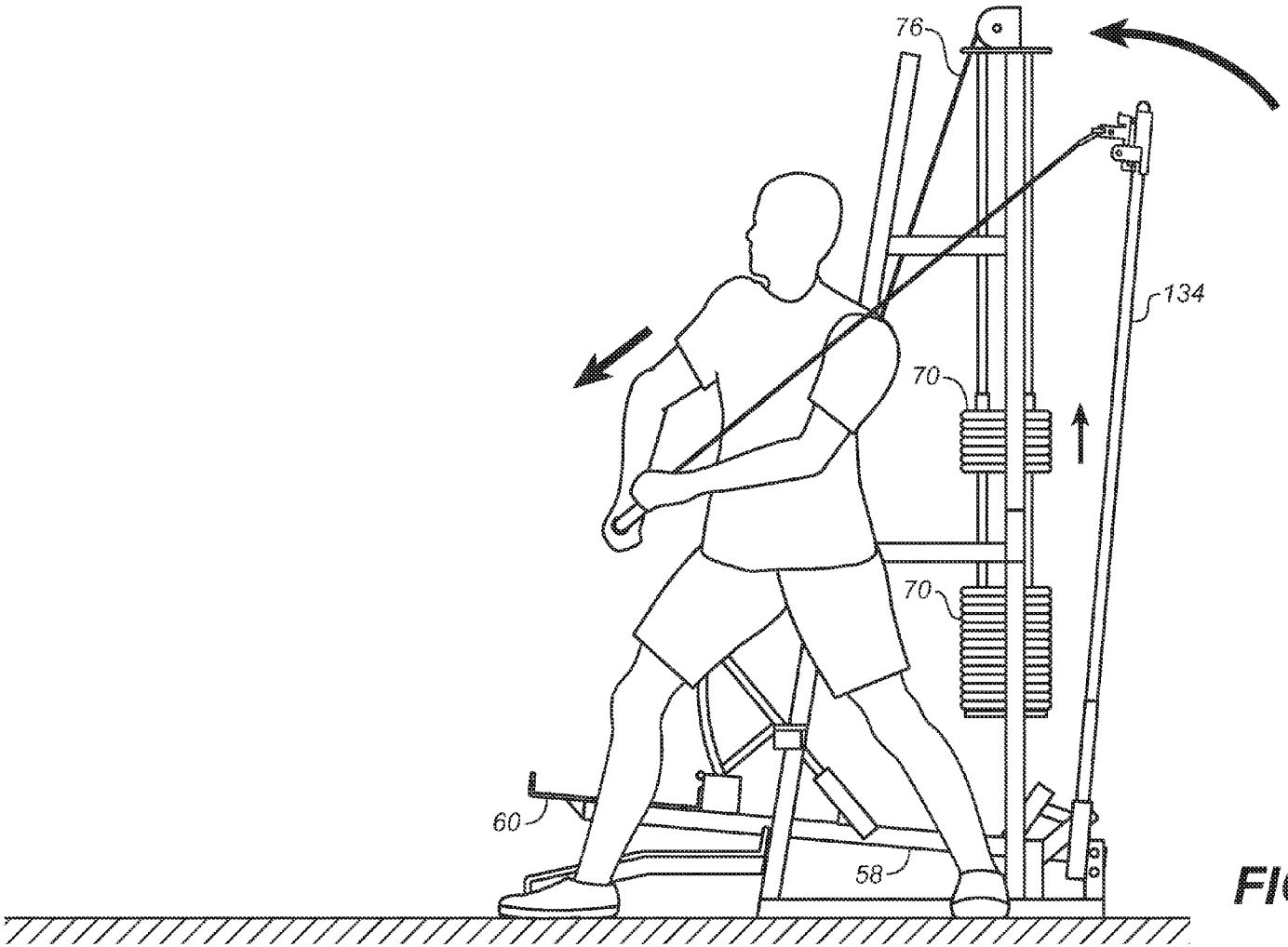
FIG. 12 B shows the user of FIG. 12A having executed the exercise.

FIGS. 12A and 12B show a user simulating a golf swing motion at the striking/throwing station.

Figure 13C:
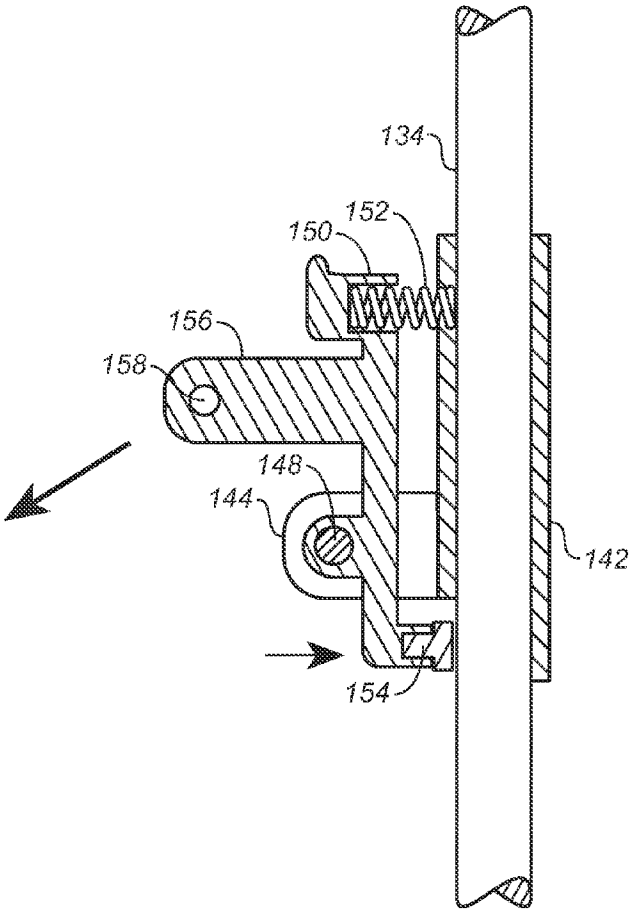
FIG. 13C is a cross-sectional side view in elevation thereof.
Figure 13A:
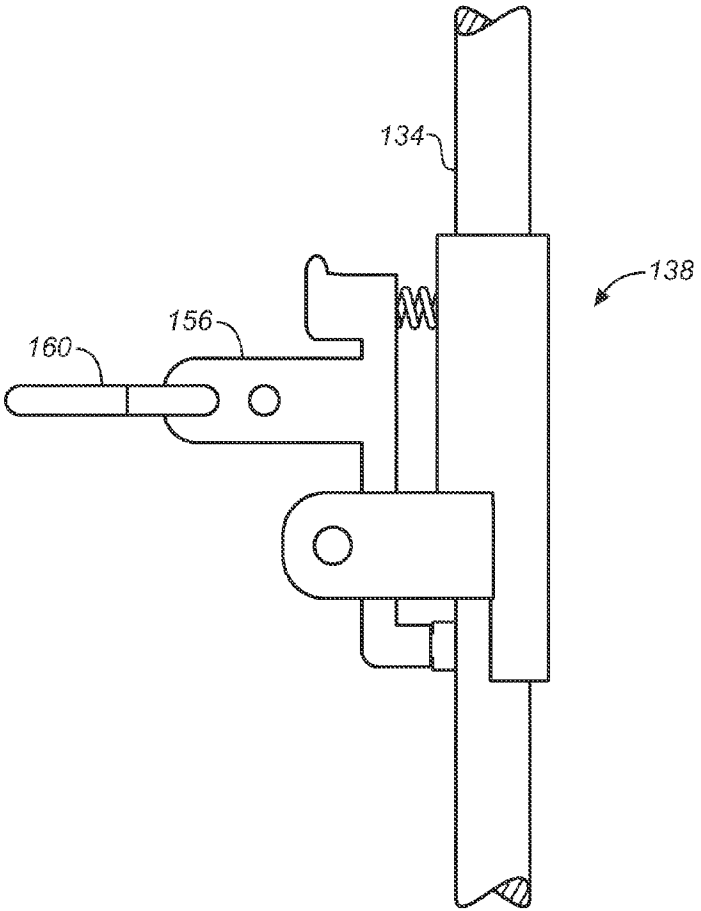
FIG. 13A is a side view in elevation showing the locking collar adapted for providing adjustable attachment to a handle (as shown in FIG. 10 et seq.)
Figure 13B:
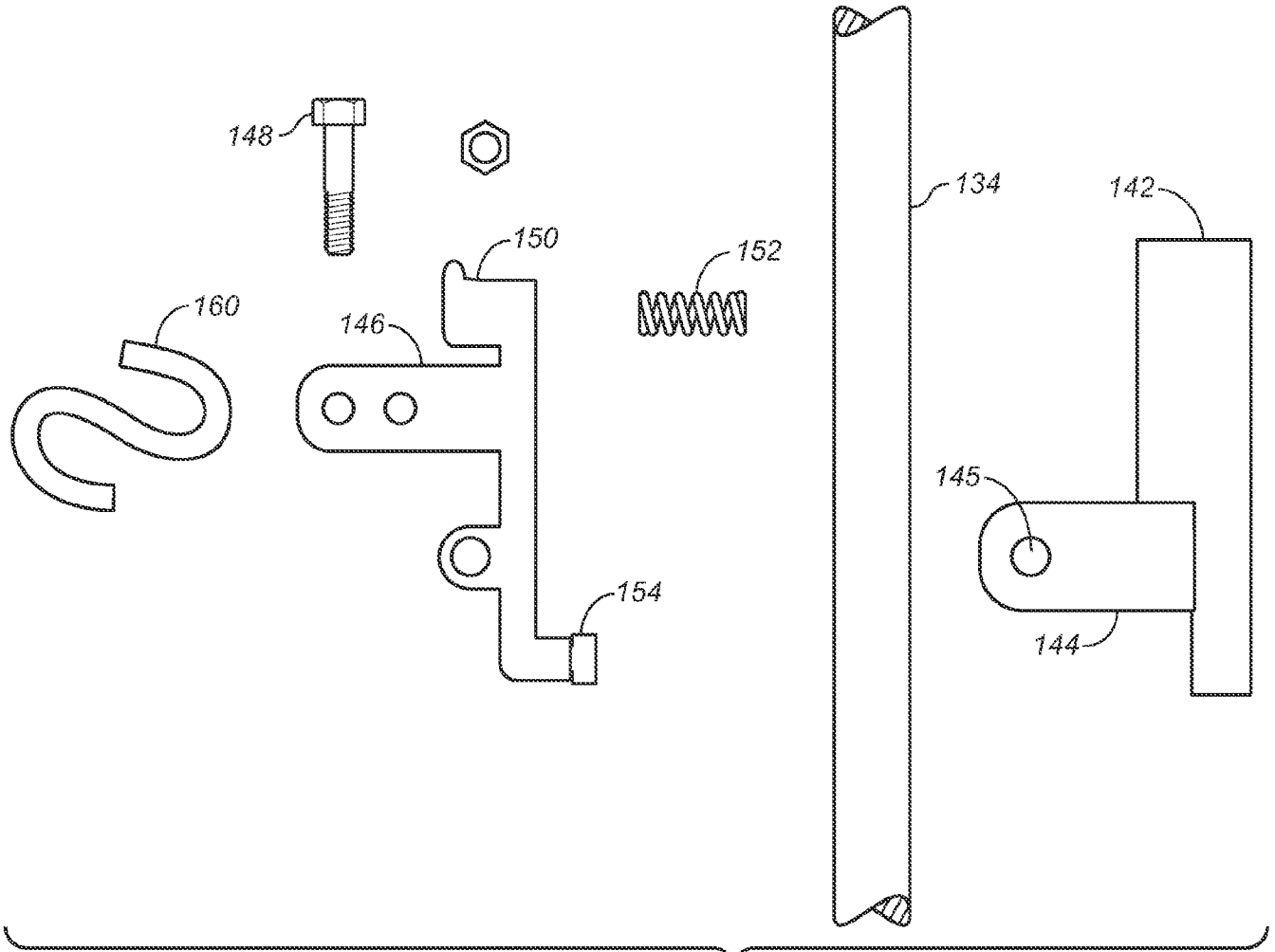
FIG. 13B is an exploded side view in elevation thereof.

FIGS. 13A-C show the slidable clamp 138 or locking collar adapted for providing adjustable attachment to the multipurpose bar or similar handles. The clamp includes a cylindrical sleeve 142 slidably placed over the end of the multipurpose bar. A bracket 144 extends from the sleeve and includes a hole 145 for the pivotal attachment of a rocker 146 with a bolt or pin 148. At its upper end, the rocker includes a cup 150 in which is disposed a compressed helical spring 152 which urges the rocker to pivot about the pin 148 and to move the upper portion outwardly from the multipurpose bar. This brings a brake shoe 154 disposed at the lower end of the rocker into contact with the multipurpose bar. Intermediate the upper and lower portions is an arm 156 that includes one or more holes 158 for the attachment of an S-hook 160, carabiner, or other quick release device suitable for attaching cable or chain to the clamp.

Figure 14B:
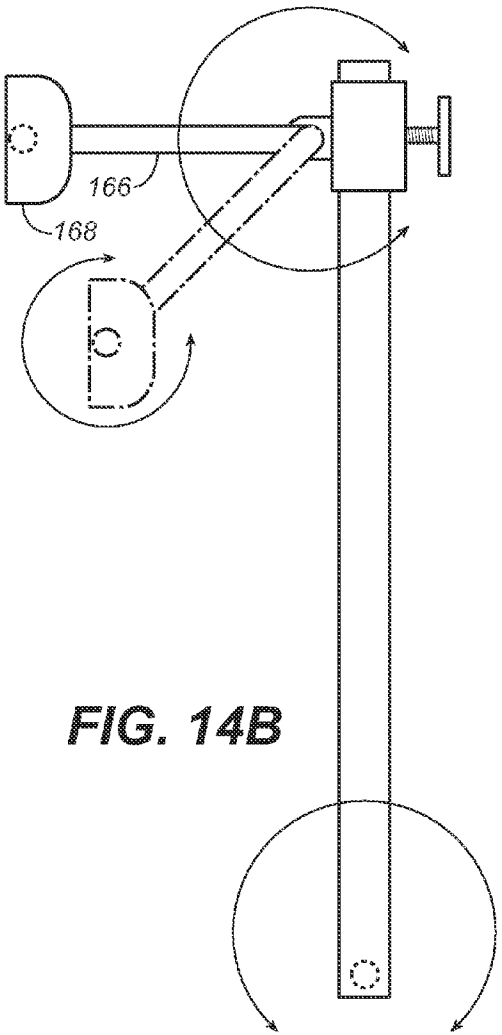
FIG. 14B is a side view in elevation thereof, showing the adjustment features of the neck station.
Figure 14A:
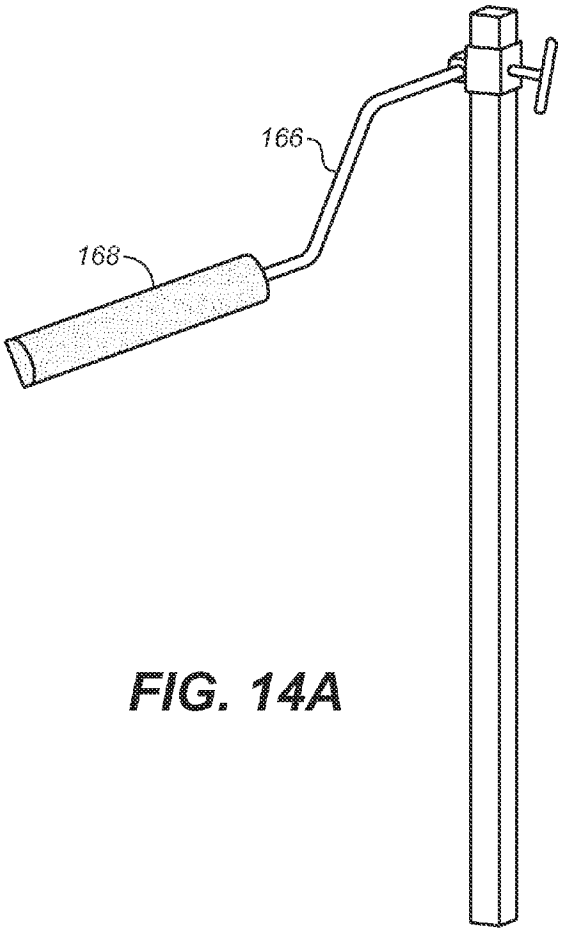
FIG. 14A is a perspective view showing a neck exercise attachment for configuring a neck exercise station.
Figure 15A:
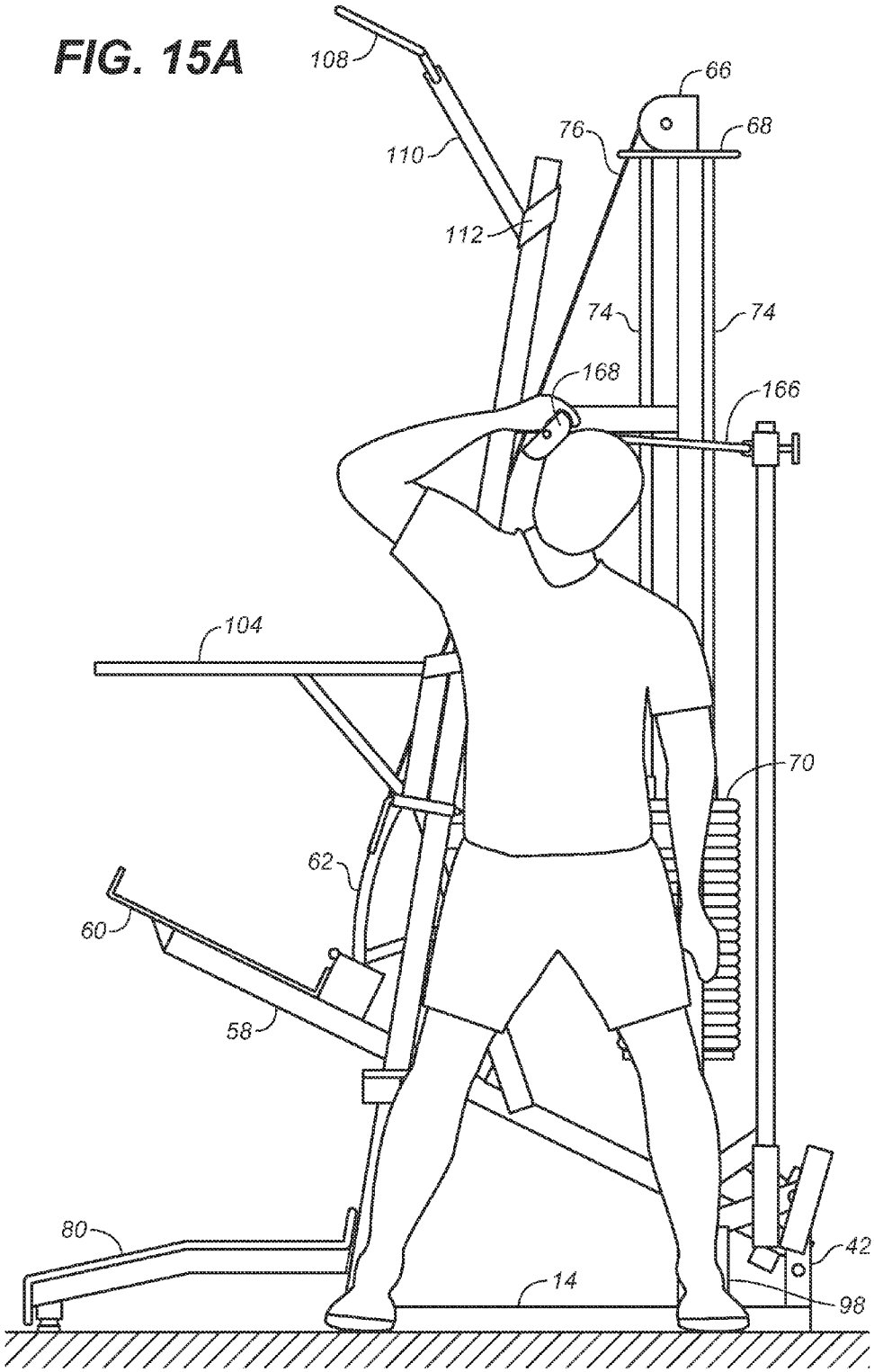
FIG. 15A is a schematic side view in elevation of a user poised to commence a side flexion neck exercise.
Figure 15B:
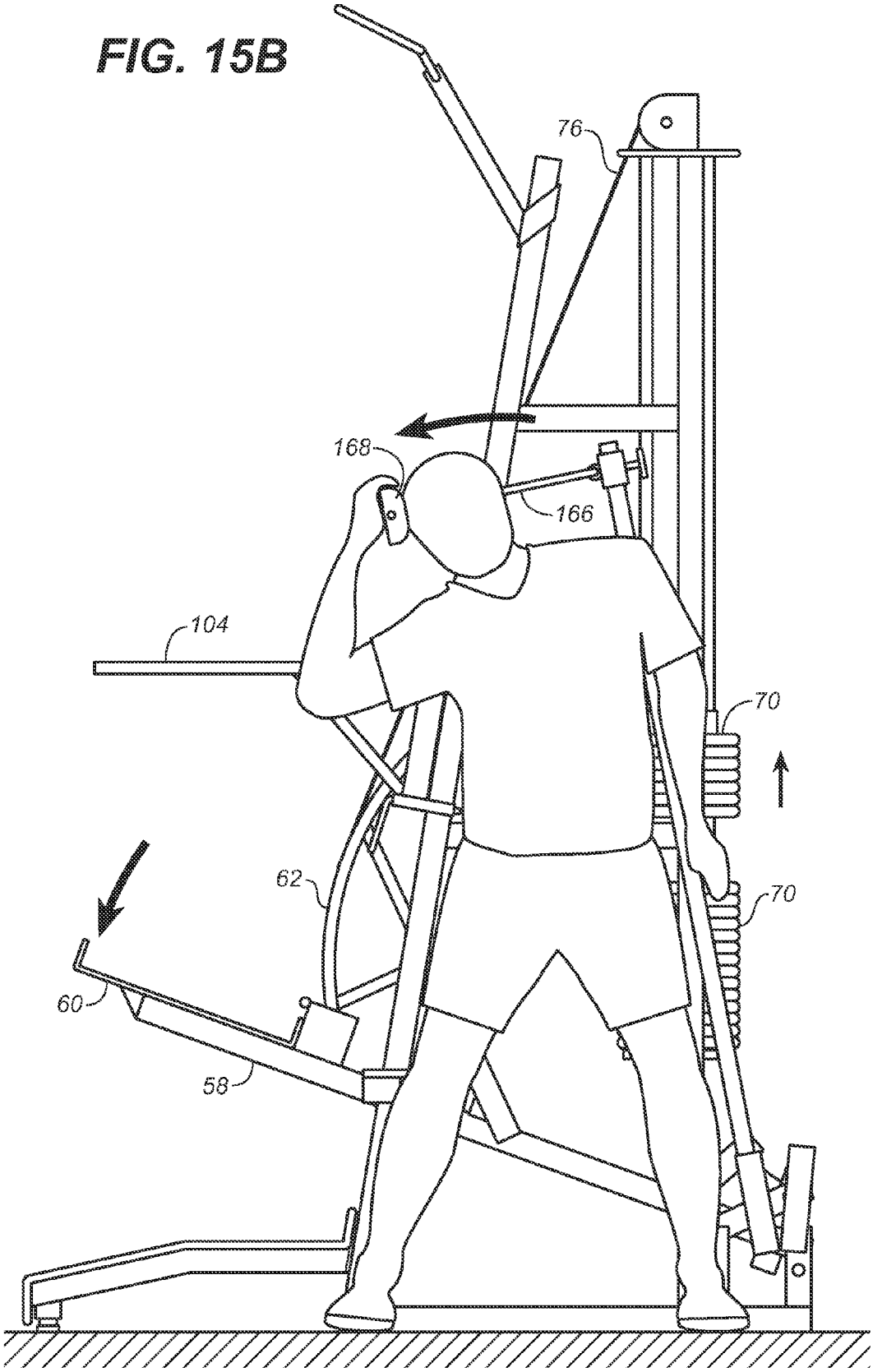
FIG. 15B shows the user having executed the exercise of FIG. 15A.
Figure 16A:
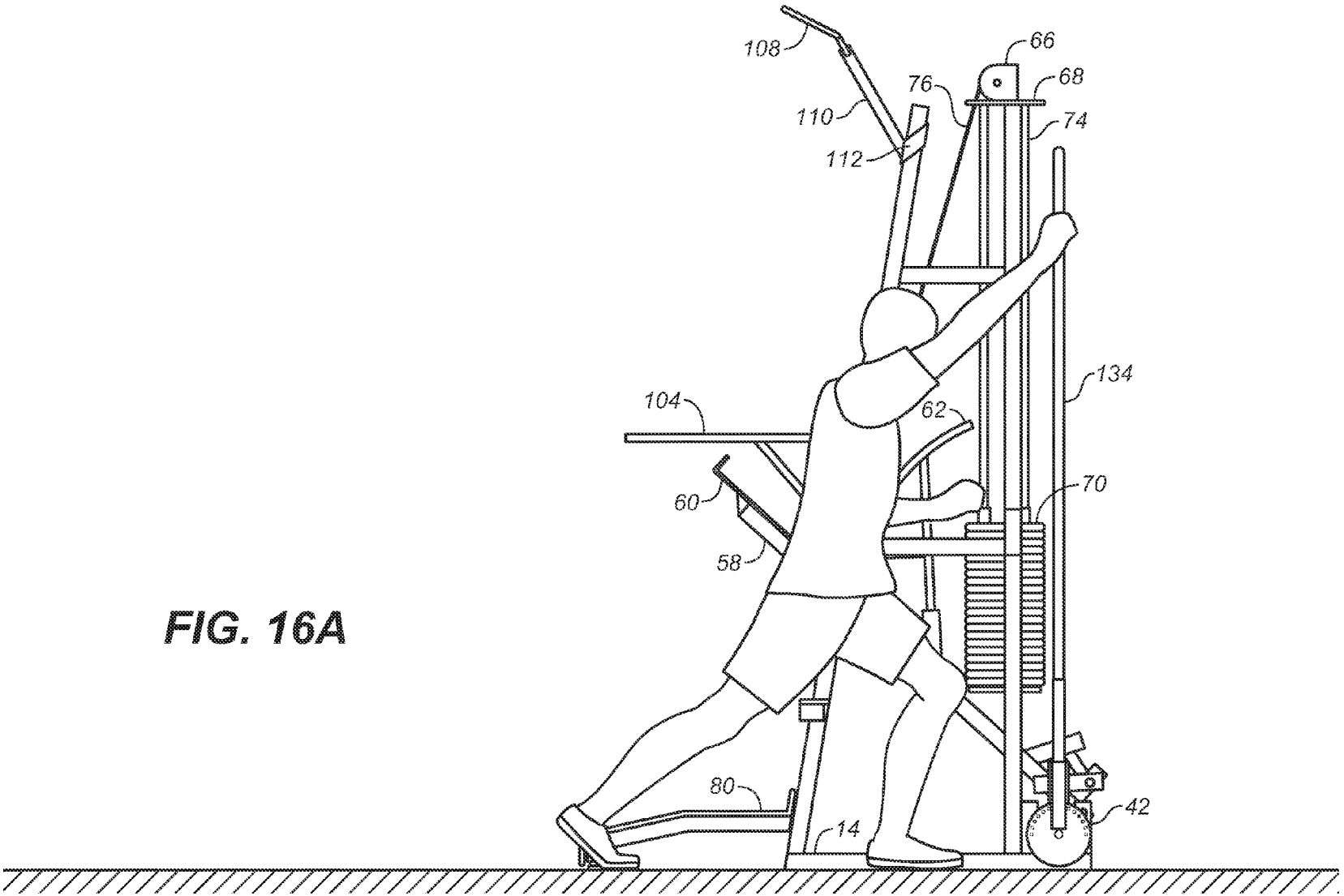
FIG. 16A shows a user prepared to execute the combination chest press with lunge (as shown previously in FIGS. 5A-B)
Figure 16B:
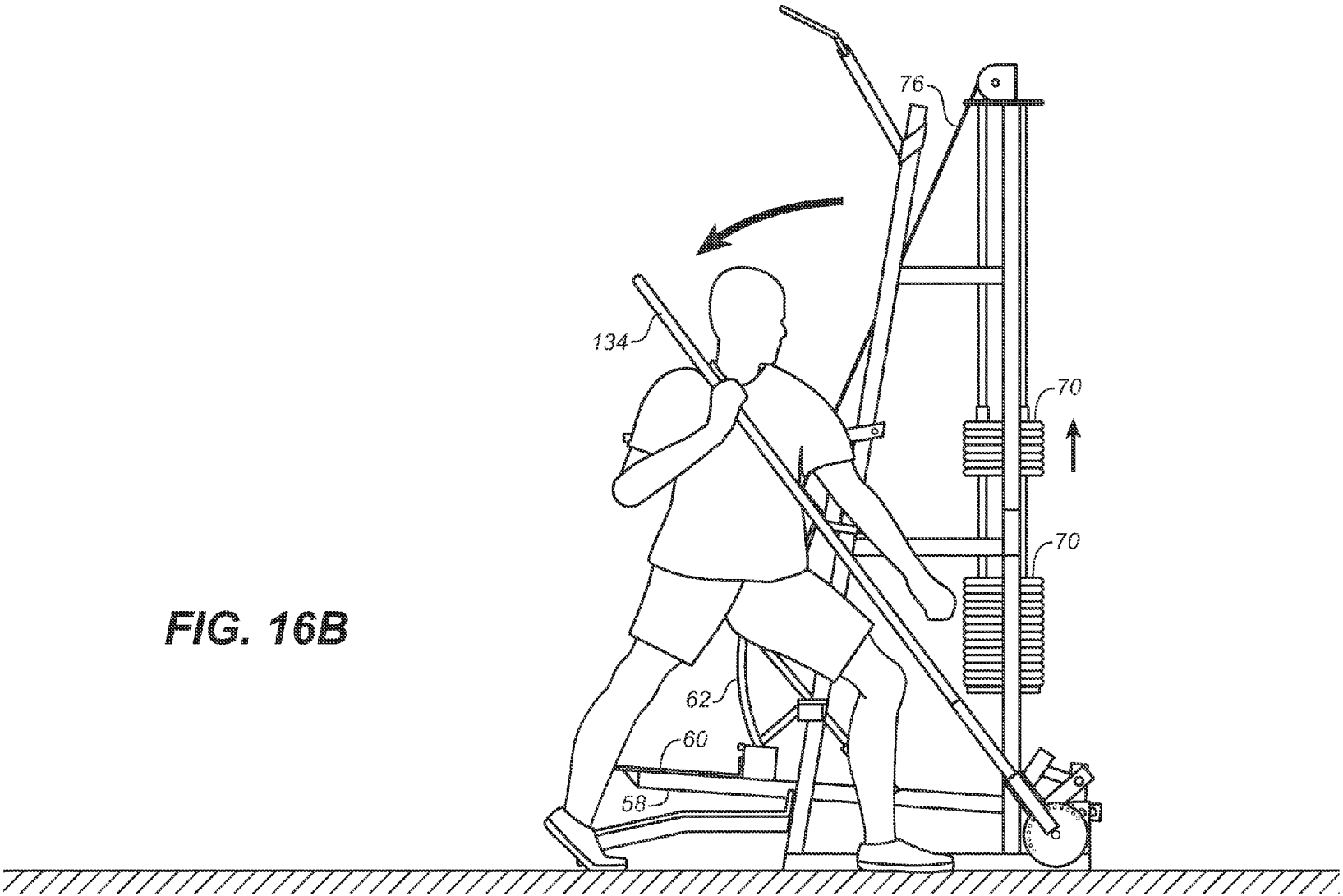
FIG. 16B shows the user having executed the chest press portion of the exercise.

FIGS. 14A and 14B show the neck station attachment 162 for the multipurpose bar. This includes a slidable collar 164 having a T-bolt for releasably securing the collar at a predetermined position along the length of the bar. A pivot bar 166 is pivotally connected to the slidable collar and includes a padded end portion 168. As shown in FIGS. 15A and 15B, as the multipurpose bar is radially translated by the user executing a neck bend or flexion, the pivot bar pivots to compensate for the collar height changes.

Figure 2:
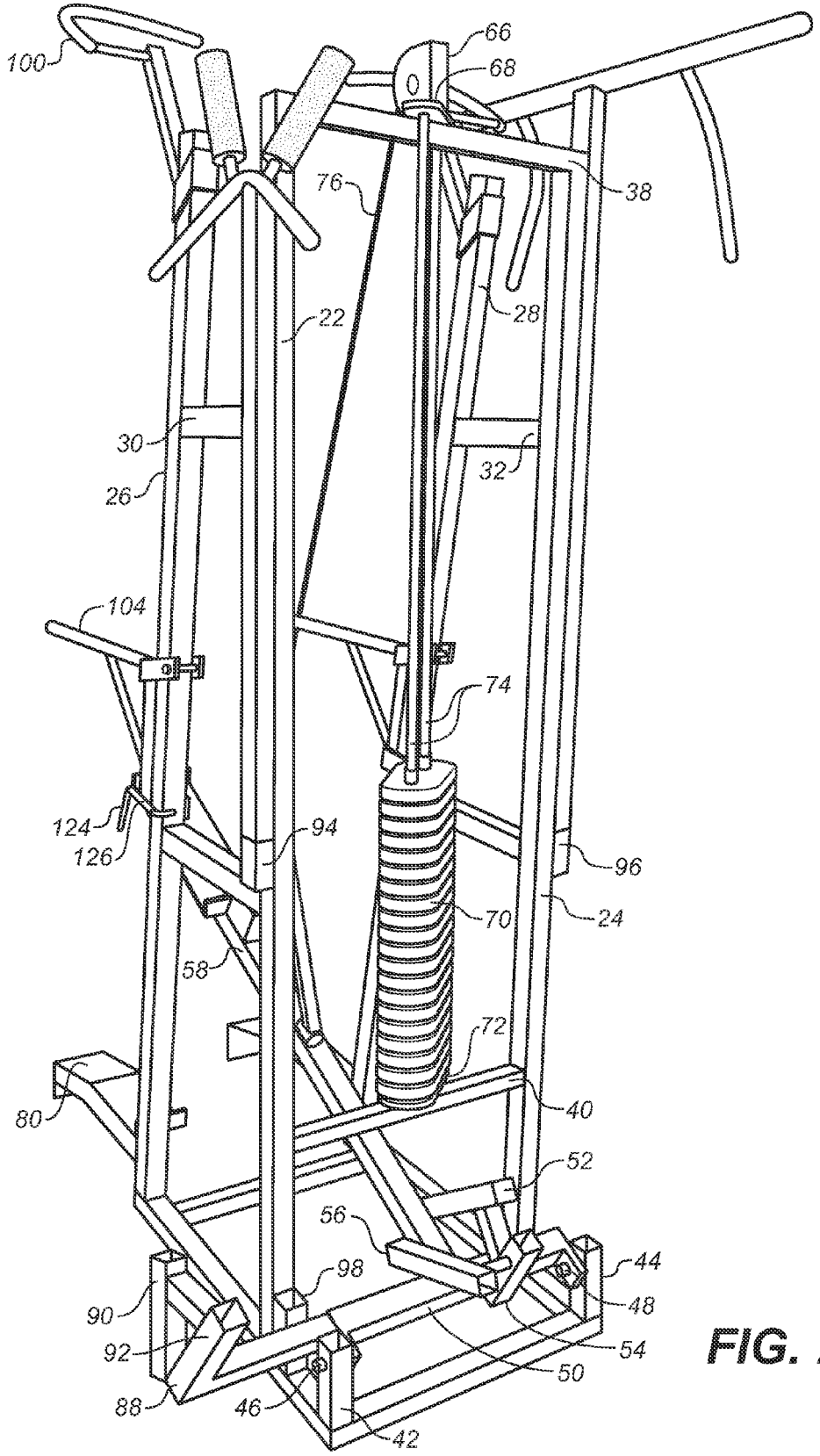
FIG. 2 is an upper right rear perspective view thereof, showing the apparatus with an optional axle extension added to enable auxiliary exercise sets.
Figure 2A:
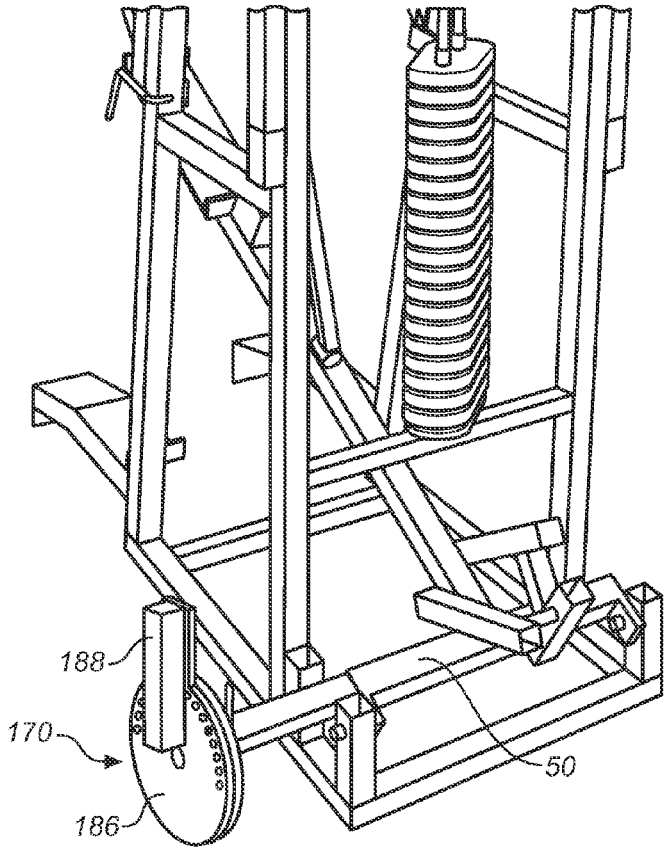
FIGS. 2A-2C show an adjustable alternative optional axle extension for auxiliary exercise sets.
Figure 2B:
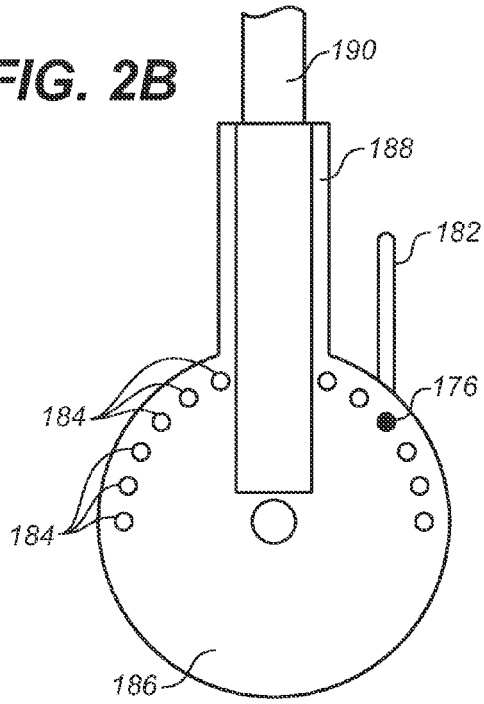
Figure 2C:
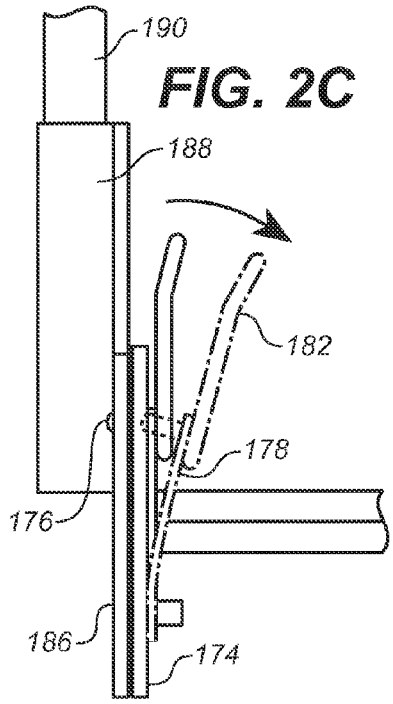
Figure 3:
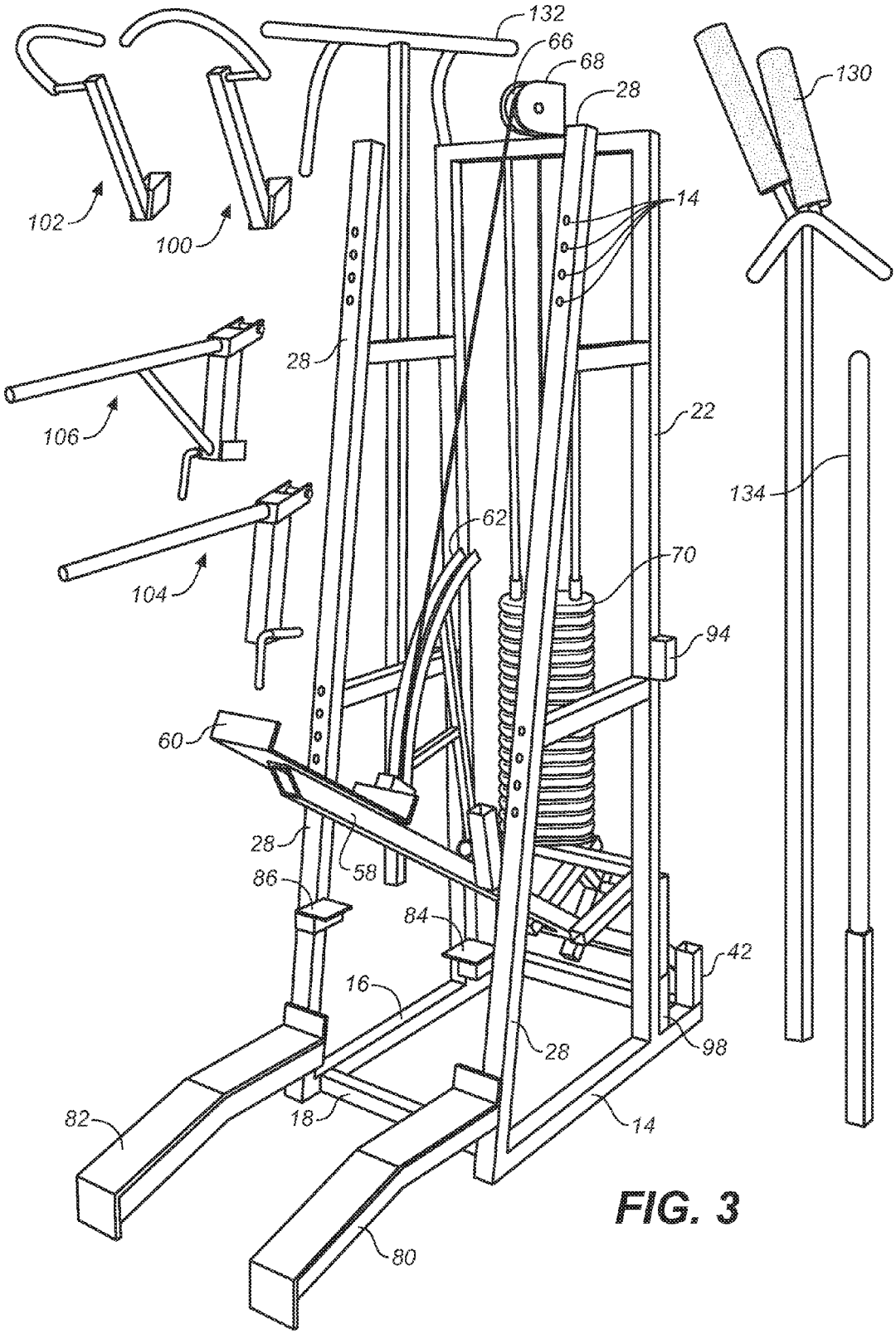
FIG. 3 is an upper front right partially exploded perspective view thereof.
Figure 3A:
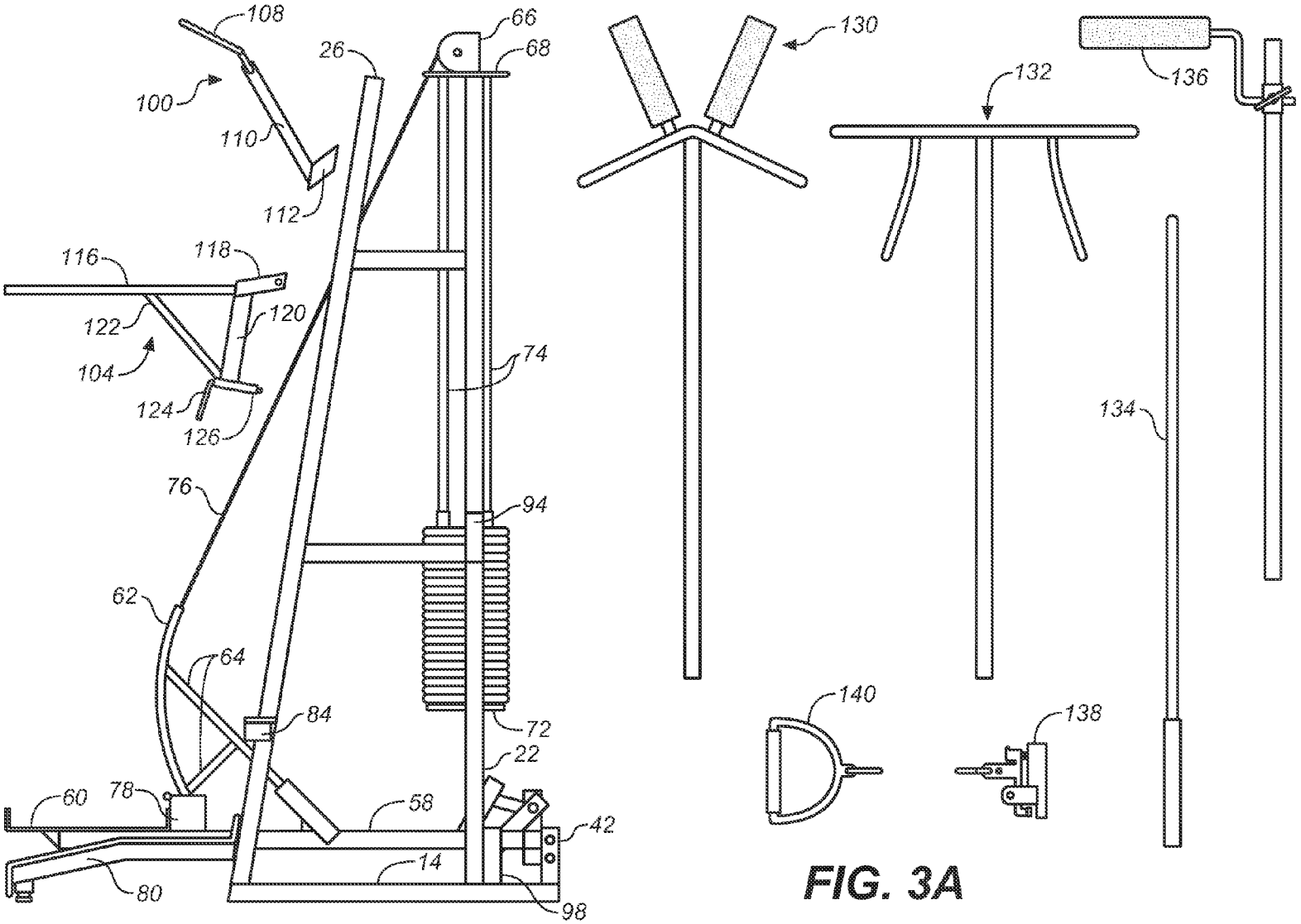
FIG. 3A is a partially exploded right side view in elevation thereof.

Referring back to FIGS. 2A-2C, there is shown an alternative adjustable axle attachment 170 for configuring the apparatus for auxiliary exercise sets. This comprises a tube 172 for insertion into connection into lever axle 50 and an end plate 174 having an index pin 176 disposed on a flat spring 178 affixed at a single point 180 to the end plate. A handle 182 is cantilevered outwardly from the flat spring and may be pulled to bend the flat spring. The index pin may thereby be selectively engaged with or disengaged from a hole in the index plate in alignment with one hole in an arcuate array of holes 184 disposed in an adjustment disc 186 rotatably mounted on the end plate. A handle receptacle 188 is affixed to and extends outwardly from the adjustment disc for insertion of an exercise set handle 190. This permits a user to set the handle at starting positions through a range of degrees defined by the arc in the arcuate array of holes.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A multistation exercise apparatus, comprising:

a base;

an upright frame including at least four vertical supports disposed on said base and a plurality of generally horizontal frame elements disposed between said vertical supports;

first and second axle supports;

an elongate lever axle pivotally disposed between said first and second axle supports;

a plurality of handle receptacles affixed to said lever axle and disposed generally rearwardly from said apparatus, said receptacles capable of receiving an end portion of a handle so as to configure the apparatus to provide a wide variety of exercises;

at least three handles, each said handle allows for a distinct exercise;

a lever arm operatively connected to, and extending generally forward from said lever axle;

an arcuate cam disposed medially on said lever arm;

a weight plate stack having a plurality of weight plates and disposed in a generally vertical orientation, said weight plate stack having a plate selection apparatus for selectively determining the number of weight plates to be lifted in a given lift;

a pulley disposed on one of said horizontal frame elements; and a cable connected to and disposed between said lever arm and said weight plate stack and disposed over said arcuate cam and said pulley;

wherein said lever axle functions as a fulcrum for radial translation of said lever arm, and resistance exercises employing said weight plate stack are performed by a user in a standing position by applying a downward force either directly to said lever arm or by radially translating one of said handle receptacles using one of said handles inserted into the one of said handle receptacles, and wherein radial translation of said lever arm or of any one of said handles connected to said lever axle through one of said handle receptacles results in the smooth upward linear translation of all or a portion of said weight plate stack.

2. The multistation exercise apparatus of claim 1, wherein said lever arm includes a foot plate so as to form a foot pedal.

3. The multistation exercise apparatus of claim 1, wherein said base comprises welded elements of square tubing in either a square or rectangular configuration.

4. The multistation exercise apparatus of claim 1, wherein said plurality of handle receptacles are affixed to said lever axle proximate a central region of said lever axle.

5. The multistation exercise apparatus of claim 1, wherein said arcuate cam is disposed medially on said lever arm and further includes frame elements for structural support.

6. The multistation exercise apparatus of claim 1, wherein said pulley is disposed on an upper rear transverse bar and said weight plate stack is supported on a weight stack base plate affixed to a lower rear transverse bar.

7. The multistation exercise apparatus of claim 6, wherein the plates comprising said weight stack slide up and down on spaced apart, side-by-side rails extending from said pulley support plate, through said weight plate stack, and to said weight stack base plate.

8. The multistation exercise apparatus of claim 1, further including steps disposed on said vertical supports for a user to mount said apparatus to exercise from an elevated position.

9. The multistation exercise apparatus of claim 1, further including a lever axle extension pivotally attached to one of said axle supports and including at least one handle receptacle for exercises that involve handle movement to the side of said upright frame.

10. The multistation exercise apparatus of claim 1, further including a plurality of handle ports disposed on said upright frame in which said at least three handles may be stored when not in use.

11. The multistation exercise apparatus of claim 1, further including a chin up station comprising adjustable chin up handles disposed on said upright frame.

12. The multistation exercise apparatus of claim 11, wherein said chin up handles each include a grip attached to an angled support extending from a sleeve that is slidably installed over one of said vertical supports, and wherein said sleeve includes a pin that inserts into a hole in said vertical support so as to secure said chin up handle at a selected height as long as said chin up handle is either under the influence of gravity or bears a load from a user, and wherein when said chin up handle is pushed upwardly, said pin is releasable from the hole and said chin up handle may be slid up or down said vertical support for adjustment to another height.

13. The multistation exercise apparatus of claim 1, further including a dip station disposed on said upright frame.

14. The multistation exercise apparatus of claim 13, wherein said dip station comprises bars having a handle portion adjustably coupled to one of said vertical supports.

15. The multistation exercise apparatus of claim 1, wherein said at least three handles includes a Y-shaped squat bar, a rowing bar, and a multipurpose bar, each of said handles having a lower end configured to insert tightly in at least one of said handle receptacles.

16. The multistation exercise apparatus of claim 1, further including a neck exercise attachment bar.

* * * * *